US007396008B2

(12) United States Patent
Sato et al.

(10) Patent No.: US 7,396,008 B2
(45) Date of Patent: Jul. 8, 2008

(54) STAPLING DEVICE

(75) Inventors: Ryuichi Sato, Kanagawa (JP); Yoshiyuki Takaishi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 298 days.

(21) Appl. No.: 11/076,988

(22) Filed: Mar. 11, 2005

(65) Prior Publication Data

US 2006/0017210 A1 Jan. 26, 2006

(30) Foreign Application Priority Data

Jul. 22, 2004 (JP) ..... 2004-214456
Jul. 22, 2004 (JP) ..... 2004-214457

(51) Int. Cl.
*B65H 37/04* (2006.01)

(52) U.S. Cl. ..... 270/58.09; 270/58.08; 227/78; 227/80; 227/93; 227/94

(58) Field of Classification Search ..... 270/58.08, 270/58.09; 227/79, 80, 93, 94
See application file for complete search history.

(56) References Cited

U.S. PATENT DOCUMENTS 5,464,201 A * 11/1995 Deen et al. ..... 270/58.09
6,466,751 B1 * 10/2002 Kawano ..... 399/68
6,474,633 B1 * 11/2002 Hirai ..... 270/58.09

FOREIGN PATENT DOCUMENTS

JP 3-25931 6/1991
JP 2001171898 A * 6/2001
JP 2001-334502 12/2001

* cited by examiner

*Primary Examiner*—Gene O. Crawford
*Assistant Examiner*—Leslie A Nicholson, III
(74) *Attorney, Agent, or Firm*—Morgan, Lewis & Bockius LLP

(57) ABSTRACT

A stapler unit has a staple section, a cutter section, and a receiving section. A stapling device further includes a staple recovery box which is disposed at a staple discarding position and which recovers the tip ends to be discarded from the receiving section; and a staple discarding mechanism which delivers the tip ends received in the receiving section of the stapler unit to the staple recovery box. One of the plural stapling positions is identical with the staple discarding position.

11 Claims, 20 Drawing Sheets

(FIG. 18 CONTINUED)
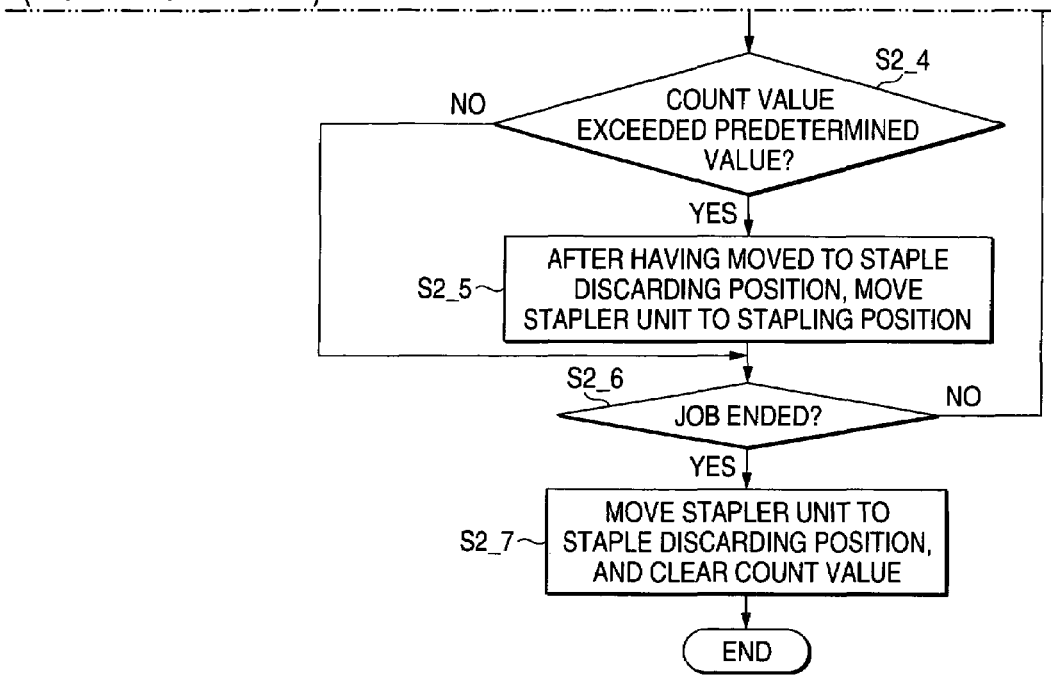

(FIG. 20 CONTINUED)
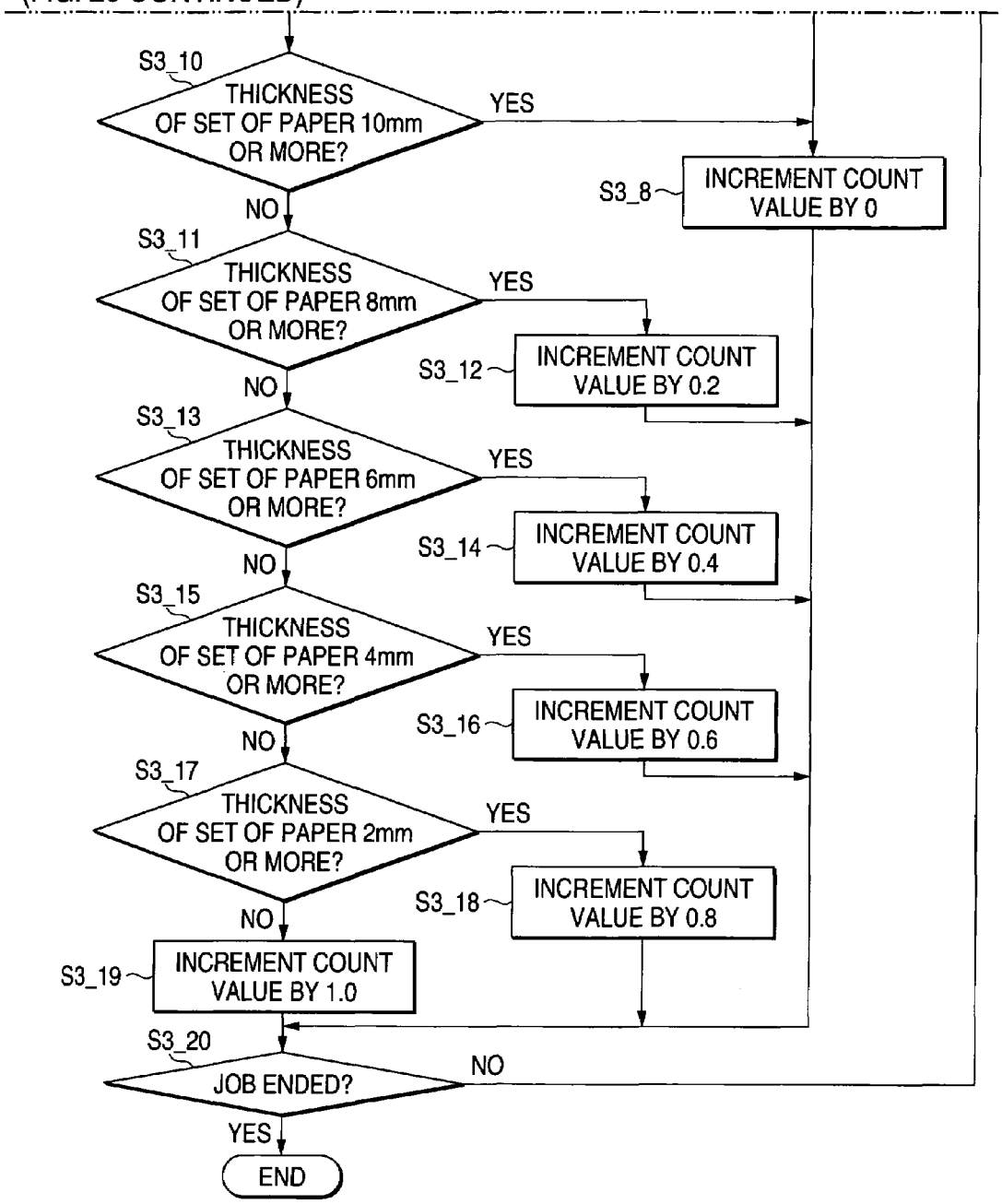

STAPLING DEVICE

BACKGROUND OF THE INVENTION

1. Field of the Invention

The present invention relates to a stapling device equipped with a stapler unit which travels along a path including a staple discarding position and plural stapling positions and performs stapling operation for fastening one position on plural stacked sheets.

2. Description of the Related Art

The above-described stapling device has hitherto been known. Of such stapling devices, a stapling device which fastens pieces of paper with one kind of staple (bent wire) regardless of the number of pieces of paper to be bound suffers a problem of tip ends of the bent staple become too long when the number of pieces of paper to be bound is small, thereby rendering the appearance of the staple poor.

In an attempt to solve the problem, there has been proposed a stapling device which offers staples of different lengths and replaces one kind of staple with another kind of staple in accordance with the number of pieces of paper to be bound (see, e.g., JP-A-2001-334502). However, this apparatus suffers a problem of operation for replacing staples becoming laborious, which in turn deteriorates operability.

For this reason, there has been proposed a stapler unit having a cutter for cutting unneeded ends of the staple (see, e.g., JP-UM-B-3-025931). The stapler unit having such a cutter is provided with a receiving section for temporarily holding staple tip ends cut during stapling operation which is performed by moving the stapler unit to a stapling position on a path. The staple tip ends received in the receiving sections are discarded into a staple recovery box disposed at a staple discarding position set on the path.

When the staple tip ends received in the receiving section are discarded into the staple recovery box, the stapler unit must temporarily depart from the stapling position. Thus, discarding the staple tip ends for preventing occurrence of overflow of staple tip ends from the receiving section results in deterioration of productivity. Meanwhile, when an attempt is made to minimize the number of operations for discarding the staple tip ends in order to improve productivity, overflow of the staple tip ends from the receiving section may arise.

When the staple tip ends received in the receiving section are discarded into the staple recovery box, the stapler unit must temporarily depart from the stapling position, thereby resulting in deterioration of productivity. For this reason, an increase in the volume of the receiving section is also conceivable. However, according to the proposal of JP-UM-B-3-025931, the volume of the receiving section is not discussed at all, and the extent to which the volume of the receiving section is to be increased is unknown.

SUMMARY OF THE INVENTION

In view of the above circumstances, the present invention provides a stapling device that achieves both a reduction in the possibility of occurrence of overflow of staple tip ends from a receiving section and minimization of a drop in productivity.

The present invention also provides a stapling device having a suitable volume.

According to a first aspect of the invention, there is provided a stapling device including: a stapler unit that travels over a path including a staple discarding position and plural stapling positions, the stapler unit including: a staple section that performs stapling operation for binding plural stacked sheets with a staple; a cutter section that cuts tip ends of the staple to be used for binding the sheets; and a receiving section that receives the tip ends cut by the cutter; a staple recovery box disposed at the staple discarding position and recovers the tip ends received by the receiving section; and a staple discarding mechanism that discards the tip ends received in the receiving section from the stapler unit into the staple recovery box, wherein one of the plural stapling positions is identical with the staple discarding position.

According to a second aspect of the invention, there is provided a stapling device including: a stapler unit that travels over a path including a staple discarding position and plural stapling positions, the stapler unit including: a staple section that performs stapling operation for binding plural stacked sheets with a staple to form a set of sheets, the sheets stacked as result of being sequentially fed; a cutter section that cuts tip ends of the staple to be used for binding the sheets; and a receiving section that receives the tip ends cut by the cutter; a staple recovery box disposed at the staple discarding position and recovers the tip ends received by the receiving section; a staple discarding mechanism that discards the tip ends received in the receiving section from the stapler unit into the staple recovery box; and a tray that accumulates a number of the set of sheets that are sequentially ejected every time the set of sheets is formed, the tray being configured a maximum number of sets of sheets to be carried, wherein the stapling unit forms the set of sheets in accordance with a job that directs the stapling operation to be performed at one or plural stapling positions selected from the plural stapling positions to form one or plural sets of sheets, and wherein the receiving section has a volume greater than a volume for holding all of tip ends cut from staples of a number required to obtain the maximum number of sets of sheets formed by stapling plural stacked sheets with staples at a maximum selectable number of the stapling positions.

BRIEF DESCRIPTION OF THE DRAWINGS

Embodiments of the present invention will be described in detail based on the following figures, wherein.

DETAILED DESCRIPTION OF THE INVENTION

Embodiments of the present invention will be hereinafter described in detail with reference to the accompanying drawings.

Figure 1:
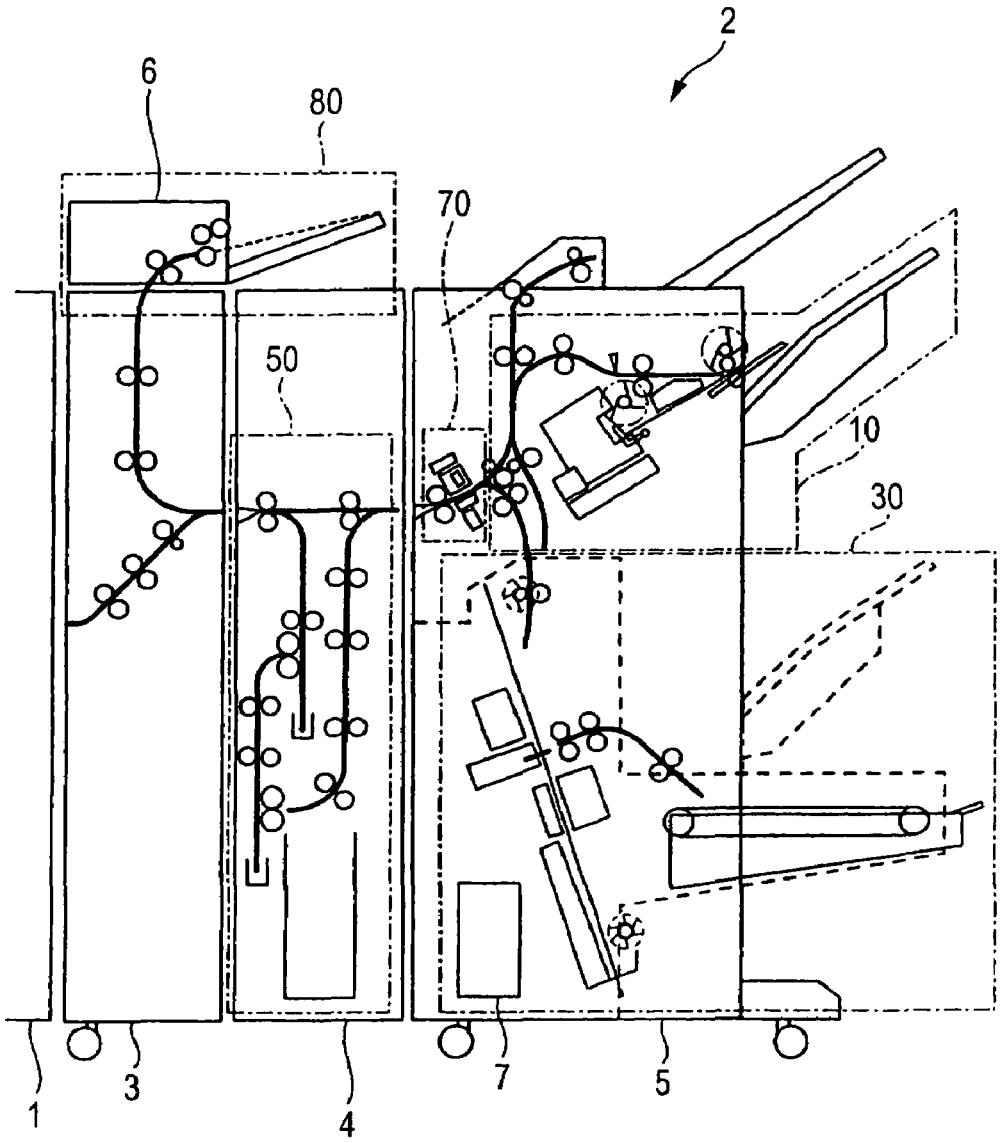
FIG. 1 is a view showing the overall configuration of a sheet processing apparatus into which is incorporated a stapling device according to an embodiment of the present invention.

FIG. 1 is a view showing the overall configuration of a sheet processing apparatus into which is built a stapling device according to an embodiment of the present invention.

A sheet processing apparatus 2 shown in FIG. 1 is connected to an image forming apparatus 1; e.g., a printer or a copier for forming a color image by means of electrophotography, and is used as a post-processing apparatus. This sheet processing apparatus 2 has a transport unit 3 connected to the image forming apparatus 1; a folding unit 4 for folding a sheet (paper) captured by the transport unit 3; a finisher 5 for subjecting the sheet having passed through the folding unit 4 to predetermined final processing; and an interposer 6 for supplying interleaving paper, such as thick paper which is to become a cover of copies or prints. The stapling device 10 according to the embodiment of the present invention is provided in the finisher 5 among the foregoing units. A control section 7 for controlling the entirety of the sheet processing apparatus 2 shown in FIG. 1, including control of the stapling device 10, is provided in the finisher 5.

In addition to the stapling operation for binding plural stacked sheets with a staple, which is to be performed by the stapling device 10 of this embodiment, the sheet processing apparatus 2 constituted of the foregoing units performs the following processing operations; namely, a saddle stitch bookbinding operation for binding a book by saddle-stitching plural stacked sheets, which is to be performed by a saddle stitch bookbinding function section 30 provided in the finisher 5; a folding operation for subjecting a sheet to C-folding or Z-folding, which is to be performed by a folding function section 50 provided in the folding unit 4; a punching operation for punching two holes or four holes in a sheet, which is to be performed by a punching function section 70 provided in the finisher 5; and a paper interleaving operation for supplying thick paper used as a cover of a set of sheets or paper with a window, which is to be performed by a paper interleaving function section 80 built from the interposer 6.

The stapling device 10 of this embodiment will now be described in detail.

Figure 2:
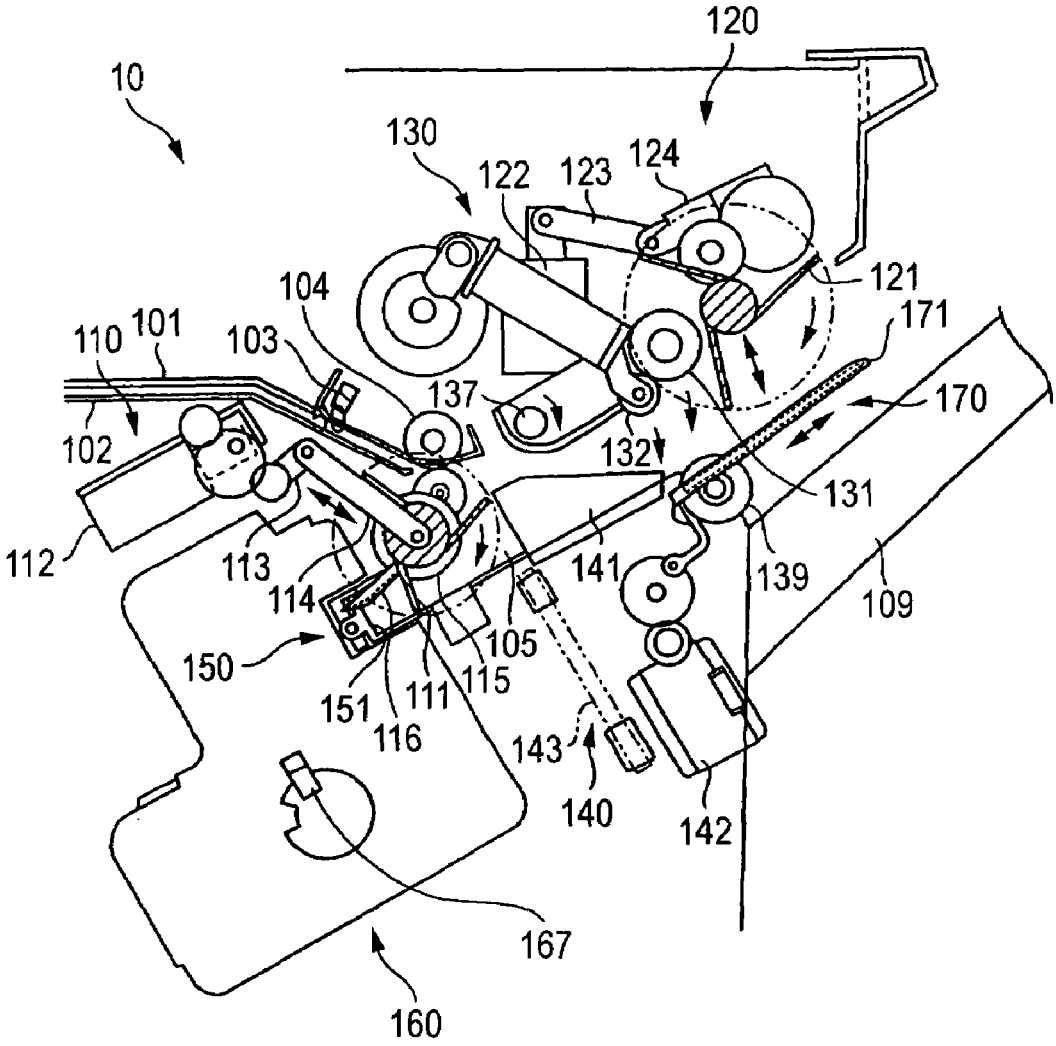
FIG. 2 is a view showing the stapling device of the embodiment placed on a finisher of the sheet processing apparatus shown in FIG. 1.

FIG. 2 is a view showing the stapling device of the present invention provided in the finisher of the sheet processing apparatus shown in FIG. 1.

The stapling device 10 shown in FIG. 2 includes a pair of transport guides 101, 102 for guiding paper to be transported; a compile exit sensor 103 which outputs a signal for controlling operations of individual mechanism sections upon detection of the transported paper; a pair of transport rollers 104 for sequentially transporting the paper transported by way of a space between the transport guides 101, 102; and a compile tray 105 for carrying the paper transported by the pair of transport rollers 104 in a stacked manner. The stapling device 10 shown in FIG. 2 is equipped with an exit tray 109 for carrying a set of sheets (a booklet) bound by a staple. When the sets of stapled sheets are piled up, the stapled portions of the sets are bowed upward, and the thus-piled sets of sheets finally collapse. Therefore, the maximum number of sets of sheets to be carried is set for the exit tray 109 in order to prevent collapse of the sets of sheets. A longitudinal reference wall 151 serving as a reference wall for longitudinally aligning sets of sheets is provided on a part of the compile tray 105 opposite a paper output direction. A lateral reference wall (not shown) serving as a reference wall for laterally aligning sets of sheets (in a direction orthogonal to a paper transport direction) is provided on, e.g., a part (a front part) of the compile tray 105 close to the viewer.

The stapling device 10 further includes, as mechanism sections for fulfilling respective functions, a longitudinal alignment section 110 for longitudinally (in a paper transport direction) aligning the paper to be fed to the compile tray 105; an auxiliary longitudinal alignment section 120 for assisting the longitudinal alignment section 110 to align paper in the paper transport direction (the longitudinal direction); a paper set support/output section 130 which presses paper to enhance consistency of plural sheets of paper piled on the compiler tray 105 at the time of performing stapling operation and which outputs a set of stapled paper; a lateral alignment section 140 which aligns paper supplied to the compile tray 105 in a direction (lateral direction) orthogonal to the paper transport direction; and an end wall 151 which becomes the longitudinal reference wall at the time of longitudinal alignment of paper. Further, the stapling device includes an end wall section 150 having a mechanism for actuating the end wall 151. The stapling device also includes a stapler unit 160 for stapling the plural sheets supplied to the compile unit 150; a shelf 171 which serves as a guide for supporting the paper piled in the compile tray 105; and a shelf mechanism section 170 having a mechanism for actuating the shelf 171. Further, the stapling device 10 has an unillustrated rail member, and the stapler unit 160 travels on the rail member.

The longitudinal alignment section 110 will first be described briefly. The longitudinal alignment section 110 has a compile paddle 111 for sequentially pressing against the end wall 151 the paper supplied to the compile tray 105; a compile paddle up/down solenoid 112 for vertically actuating (retracting/advancing) the compile paddle 111; links 113, 114 which rotate or slide in conjunction with movement of the compile paddle up/down solenoid 112; and regulation guides 115, 116 for assisting alignment of paper, such as pressing of tightly curled paper. The compile paddle 111 is formed from, e.g., EPDM, and three blades or thereabouts are attached to one compile paddle 111. By means of these blades, the rear end of the paper supplied to the compile tray 105 is pressed against the end wall 151. By means of the pressing operation, the rear end of the paper is aligned (longitudinally).

Next, the auxiliary longitudinal alignment section 120 will be described briefly. The auxiliary longitudinal alignment section 120 includes a sub-paddle 121 for assisting operation for pressing the paper supplied to the compile tray 105 against the end wall 151; a sub-paddle up/down solenoid 122 for vertically actuating (retracting/advancing) the sub-paddle 121, such as elevating the position of the sub-paddle 121, when the number of pieces of paper has reached a predetermined number (50 pieces of paper); and links 123, 124 for vertically actuating the sub-paddle 121 in conjunction with the sub-paddle up/down solenoid 122. Like the compile paddle 111, the sub-paddle 121 is formed from, e.g., EPDM, and three blades or thereabouts are attached to one sub-paddle 121. By means of the blades, longitudinal alignment of the paper supplied to the compile tray 105 is assisted.

Subsequently, the paper set support/output section 130 is also described briefly. The paper set support/output section 130 has an eject roller 131 which presses paper against an opposing roller 139, to thus support paper and eject a set of paper; and a press roller 132 for pressing, e.g., a vicinity of folded portions of Z-folded sheet. In relation to the eject roller 131, the press roller 132 is provided toward a compiling direction (i.e., a direction opposite the paper output direction)), and is configured to be able to press a vicinity of a folded portion of paper when the paper has become A4 size as a result of Z-folding A3-size paper (A3SEF). The eject roller 131 and the press roller 132 rotate around a rotary center shaft 137. Plural sheets of paper which have been stapled into a set on the compile tray 105 are nipped by the eject roller 131 and the opposing roller 139. The eject roller 131 is rotated by an unillustrated eject motor and outputs a set of paper toward the exit tray 109. After having output the set of paper, the unillustrated eject motor rotates the eject roller 131 in reverse so as to transport the paper in the compiling direction opposite the output direction, at a timing when paper is first transported to the empty compile tray 105.

The lateral alignment section 140 shown in FIG. 2 will now be described briefly. The lateral alignment section 140 includes a tamper 141 for laterally aligning the paper fed to the compile tray 105 one sheet at a time from the rear side of the stapling device toward the front side thereof; a tamper motor 142 serving as a drive source for reciprocally actuating the tamper 141; and a belt 143 for transmitting driving force of the tamper motor 142 to the tamper 141.

Subsequently, the stapler unit 160 will be described.

Figure 3:
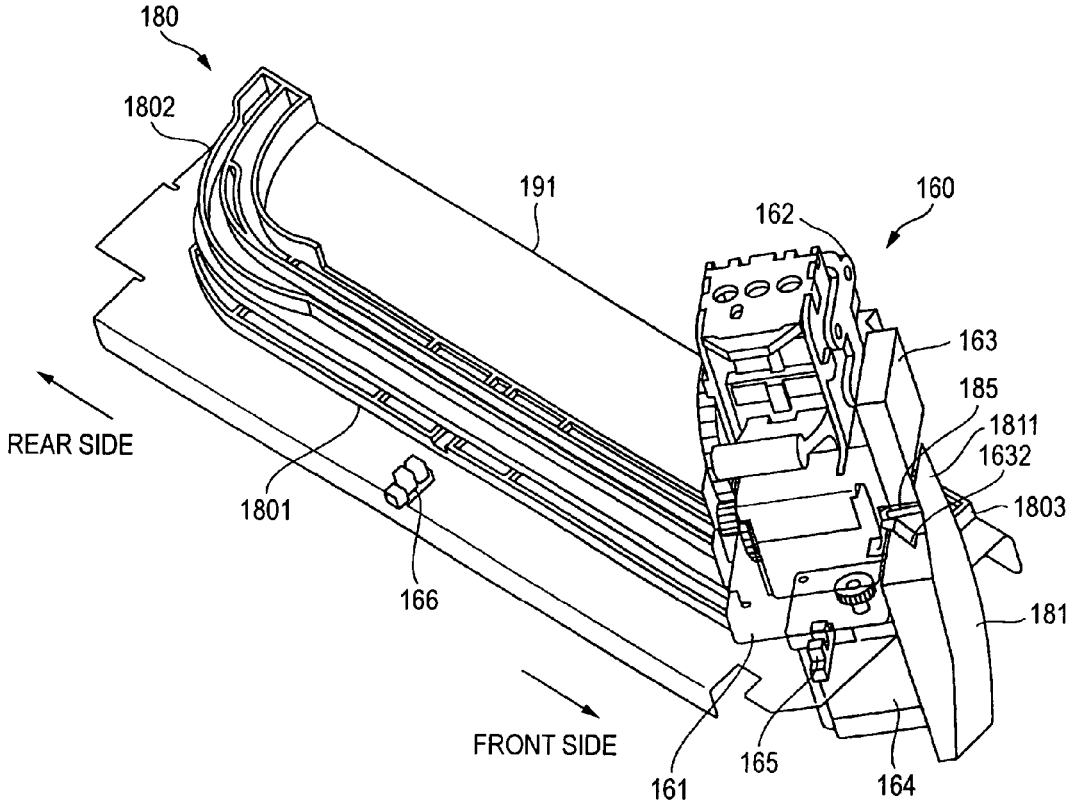
FIG. 3 is a view showing a stapler unit placed on a rail member omitted from the previous illustrations.

FIG. 3 is a view showing the stapler unit placed on the rail member which has been omitted from the drawings thus far.

The stapler unit 160 shown in FIG. 3 travels over the rail member 180 connecting the staple discarding position and the plural stapling positions. A staple center position sensor 166 is disposed at a center position of the rail member 180 in an extending direction thereof, for detecting whether or not the stapler unit 160 is situated at the center position. The rail member 180 is formed on a base 191 and has a linear portion 1801 and R portions 1802, 1803 connected to the respective ends of the linear portion 1801. FIG. 2 shows the stapler unit 160 situated on the right R portion 1803. The position of the stapler unit 160 shown in FIG. 3 is a staple discarding position, and this position is located outside a housing of the stapling device; namely, a housing of the finisher 5 shown in FIG. 1. Explanation is now given by reference to FIG. 4 as well as to FIG. 3.

Figure 4:
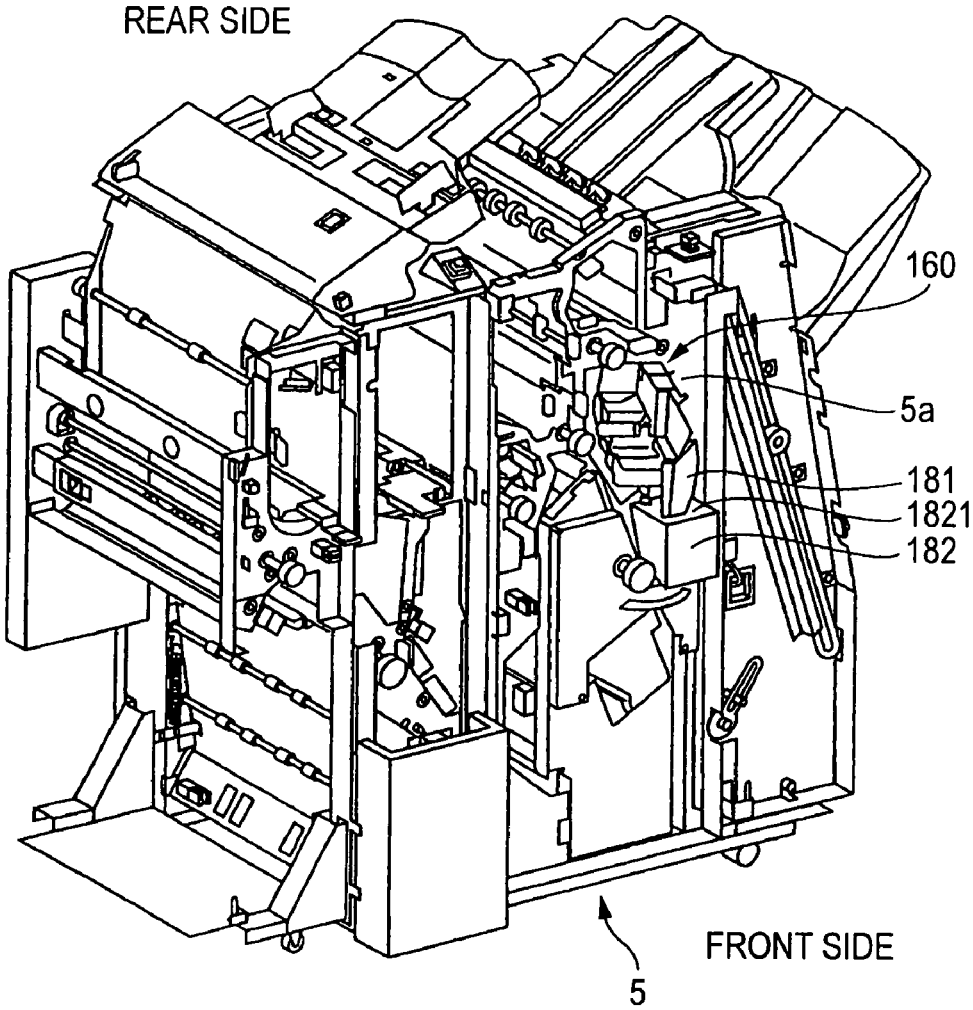
FIG. 4 is a perspective view showing the sheet processing apparatus shown in FIG. 1 with a front panel thereof removed.

FIG. 4 is a perspective view showing the sheet processing apparatus shown in FIG. 1 when a front panel of the sheet processing apparatus is removed.

FIG. 4 is a perspective view of the sheet processing apparatus when the apparatus is viewed from the front surface thereof that faces an operator, and a portion of the sheet processing apparatus closer to the viewer comes to the front side. FIG. 4 shows that the stapler unit 160 shown in FIG. 3 is situated outside a housing frame 5*a* of the finisher 5; that is, the front surface side of the sheet processing apparatus outside the housing of the stapling device 10. The stapler unit 160 shown in FIG. 4 is situated at the staple discarding position as is the stapler unit 160 shown in FIG. 3. The stapler discarding position of this embodiment is a position provided on the front surface outside the housing and corresponds to a home position of the stapler unit 160. A sensor is required to stop the stapler unit 160 at a desired position. However, the sensor to be disposed at the staple discarding position can double as a sensor to be used for stopping the stapler unit at a desired position, thereby leading to a cost reduction. The staple discarding position is also one of the plural stapling positions. Therefore, the sensor to be disposed at the staple discarding position can double as a sensor to be disposed at the stapling position, which in turn leads to additional cost reduction.

Figure 5:
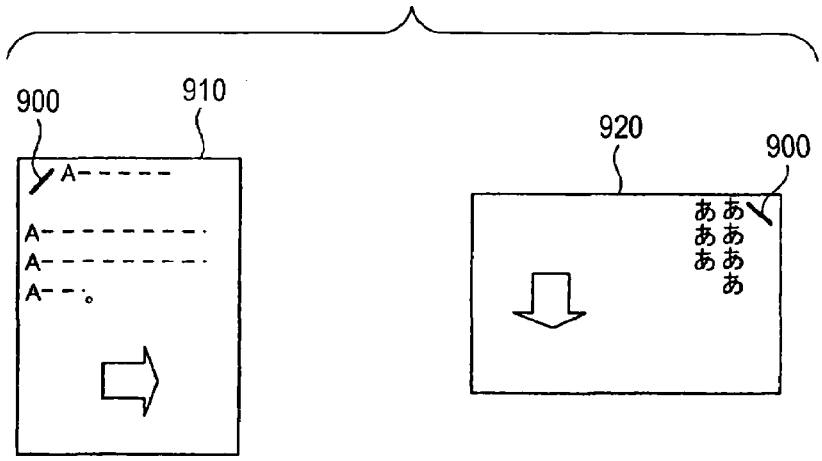
FIG. 5 is a view showing a row of horizontally-oriented letters and a row of vertically-oriented letters, both being arranged on A4-size paper.

FIG. 5 is a view showing an example where horizontally-oriented character strings and vertically-oriented character strings are arranged on A4-size paper.

Plural rows of horizontally-oriented character strings are longitudinally arranged on paper 910 of A4 size provided on the left part of FIG. 5. In the case of such A4 paper for horizontal writing, a point on the upper left corner which is bound by a staple 900 with the highest frequency. As indicated by an arrow, the paper is transported toward the stapling device 10 along a lateral direction. Further, plural lines of vertically-oriented character strings are arranged, in a longitudinal direction, on the A4-size paper 920 provided on the right part of FIG. 5. In the case of such A4 paper for vertical writing, the position which is to be bound by the staple 900 with the highest frequency is a point on the upper right corner. As indicated by an arrow, paper is transported toward the stapling device 10 in a lateral direction. Specifically, the points on the upstream upper corners of the paper transported to the stapling device 10 in the paper transport direction are positions which are used as the stapling positions 10 with the highest frequency. In the stapling device 10 of this embodiment, the stapling positions to be used with the highest frequency are taken as the staple discarding positions. Namely, the stapling position identical with the staple discarding position is a stapling position where the upper left position on the A4-size paper for horizontal writing is bound by the staple 900.

The stapler unit 160 shown in FIG. 3 includes a staple section 161 for actually performing stapling operation; a cutter section 162 for cutting tip ends of a staple by an amount corresponding to the thickness of a set of sheets to be formed or the number of sheets; a receiving section 163 for holding tip ends cut by the cutter section 162; a stapler unit movement motor 164 which is a stepping motor to become a drive source for moving the stapler unit 160 over the rail member 180; and a stapler unit movement sensor 165 for detecting that the staple section 161 has performed operation for moving the stapler. Moreover, as shown in FIG. 2, the stapler unit 160 is also equipped with a staple operation detection sensor 167 for detecting that the stapler section 161 has performed stapling operation. Although the stapler section 161 has a staple pounding port for pounding a staple into plural stacked sheets, the port is located at a position opposite the staple section 161 shown in FIG. 4. Therefore, the staple pounding port is not shown. The stapler unit 160 shown in FIG. 2 corresponds to a view of the stapler unit located at the linear portion 1801 of the rail member 180 shown in FIG. 3 when viewed from an extension of the linear portion 1801, wherein the end wall 151 is situated in the vicinity of the staple pounding port. The receiving section 163 has a volume greater than a volume for holding all of tip ends cut from staples of a number required to obtain the maximum number of sets of sheets for the exit tray 109 shown in FIG. 1.

The stapling device 10 of this embodiment has a duct chute 181 and a staple recovery box 182. The duct chute 181 and the staple recovery box 182 are disposed at the staple discarding position, and the staple recovery box 182 is removable. FIG. 3 shows the duct chute 181, and FIG. 4 shows the duct chute 181 located beneath the stapler unit 160 moved to the staple discarding position, and the staple recovery box 182 located below the duct chute 181. The tip ends of staples held in the receiving section 163 are charged from the stapler unit 160 moved to the staple discarding position into an inlet port 1821 of the staple recovery box 182 by way of the duct chute 181. The staple discarding position where the staple recovery box 182 is disposed is outside the housing. Hence, when the tip ends of staples held in the housing section 163 are discarded to the staple recovery box 182, the tip ends of staples are prevented from scattering within the finisher 5 shown in FIG. 1 where the stapling device 10 is disposed. Further, the staple recovery box 182 is disposed on the front surface side of the sheet processing apparatus, and operation for removing the staple recovery box is easy. Moreover, the duct chute 181 prevents the tip ends of staples from scattering outside the finisher 5.

The receiving section 163, the duct chute 181, and the staple recovery box 182 are all formed from a conductive member, thereby preventing catching of the tip ends of staples, which would otherwise be caused by static electricity. Consequently, the degrees of freedom of tilt angles to be imparted to the respective members 163, 181, and 182 are broadened, thereby facilitating design of geometries of the respective members.

Figure 6A:
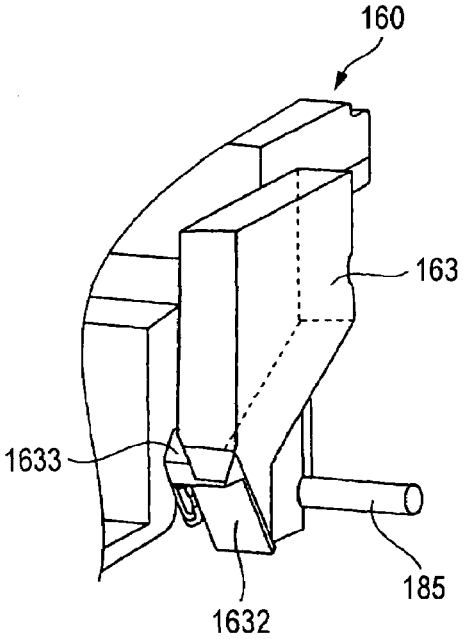
FIGS. 6A and 6B are views showing discarding of staple tip ends from a receiving section into a staple recovery box.
Figure 6B:
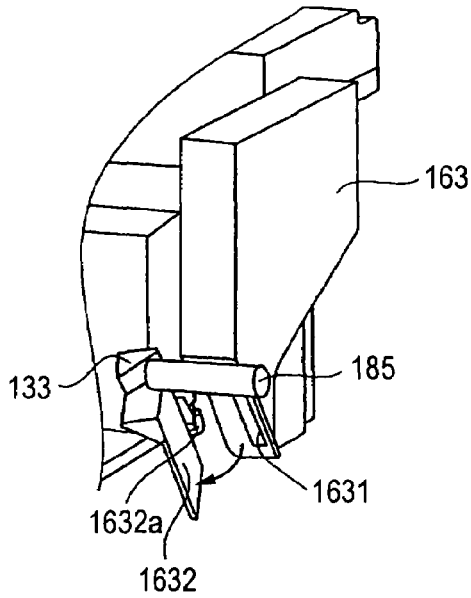

FIGS. 6A and 6B are views showing the way in which the tip ends of a staple are discarded from the receiving section into the staple recovery box 182.

FIG. 6A shows the neighborhood of the housing section of the stapler unit situated at a position away from the staple discarding position, and FIG. 6B shows the neighborhood of the housing section of the stapler unit situated at the staple discarding position.

A discarding port 1631 to be used for discarding tip ends of the held staples is formed in the bottom of the receiving section 163 (see FIG. 6B), and an open-close cover 1632 which removably covers the discarding port 1631 by means of a hinge mechanism 1632*a* is disposed on the bottom of the housing section. This open-close cover 1632 is impelled in a direction to close the discarding port 1631 by an unillustrated spring. The stapling device 10 is provided with an engagement pin 185 which engages with the open-close cover 1632 disposed in the receiving section 163 of the stapler unit 160 which moves toward the staple discarding position. The open-close cover 1632 is provided with an engagement section 1633 which is to engage with the engagement pin 185. When the stapler unit 160 has moved to the neighborhood of the staple discarding position, the engagement pin 185 comes into contact with the engagement section 1633 provided in the open-close cover 1632. Moreover, when the stapler unit 160 has moved toward the staple discarding position, the engagement section 1633 is pressed by the engagement pin 185, whereby the open-close cover 1632 starts rotating in the direction of the arrowhead shown in FIG. 6B against the impelling force originating from an unillustrated spring. When the stapler unit 160 has arrived at the staple discarding position, the open-close cover 1632 remains open, as shown in FIG. 6B, and the tip ends of the staples are discarded by way of the discarding port 1631. Therefore, a mechanism for causing the engagement pin 185 to engage with the engagement section 1633 corresponds to the staple discarding mechanism described in the claims. In the stapling device 10 of this embodiment, when the stapler unit 160 has reached the staple discarding position, the receiving section 163 becomes empty. Further, as mentioned previously, in the stapling device 10 of this embodiment, the position that is used as the stapling position with the highest frequency coincides with the staple discarding position. Hence, the tip ends of the staples can be frequently discarded without involvement of a decrease in productivity. Thus, both a decrease in possibility of overflow of tip ends of staples from a receiving section and minimization of a drop in productivity are achieved. Moreover, since the staple discarding position is the home position, the tip ends of the staples stored in the receiving section 163 are discarded to the staple recovery box 182, thereby rendering overflow of the tip ends from the receiving section 163 less likely to arise.

As shown in FIG. 6B, the discarding port 1631 of the receiving section 162 is disposed at a position spaced away from the hinge mechanism 1632*a*. This is contrivance to fully evacuate the open-close cover 1632 from the path where the tip ends of staples discarded from the discarding port 1631 fall.

Explanation is resumed by reference to FIGS. 3 and 4 as well as FIG. 6. The discarding port 1631 of the receiving section 163 belonging to the stapler unit 160 shown in FIG. 3 is situated at an outer peripheral side of an R portion 1803 of the rail member 180. Moreover, a staple belonging to the stapler unit 160 shown in FIG. 3 is situated at an outer peripheral portion of the R portion 1803 of the rail member 180. Moreover, the unillustrated staple pounding port of the staple section 161 is situated on an inner peripheral side of the R portion 1803. Therefore, in the course of moving from the linear portion 1801 to the R portion 1803, the stapler unit 160 changes its attitude to that shown in FIG. 3, where the stapler unit 160 is inclined 45° with reference to that achieved in the linear portion 1801, while the rear side of the stapler unit 160 having the discarding port 1631 formed therein is moved over a greater distance than is the front side of the same having the unillustrated stapling pounding port. Specifically, the stapler unit 160 assumes, at the staple discarding position, an attitude such that the discarding port 1631 is further inclined outside of the housing, while being inclined substantially in line with the compile tray 105.

As shown in FIG. 4, the duct chute 181 is fixedly mounted outside of the housing and has a splash prevention plate 1811 extending upwardly so as to cover the bottom of the receiving section 163 shown in FIG. 3 from the side thereof. Specifically, the splash prevention plate 1811 is located at a position opposite the opened open-close cover 1632 of the receiving section 163; that is, the hinge mechanism 1632*a* of the open-close cover 1632. In the staple discarding position, the discarding port 1631 of the receiving section 163 is situated between the opened open-close cover 1632 and the splash prevention plate 1811. Sideways splashing of staple tip ends discarded by way of the discarding port 1631 is prevented by the open-close cover 1632 and the splash prevention plate 1811. The previously-described engagement pin 185 is secured on the splash prevention plate 1811 shown in FIG. 3. This splash prevention plate 1811 may be provided in the receiving section 163.

The stapling device 10 of this embodiment described above forms a set of paper stapled in accordance with a job. The term "job" used herein denotes a command for forming one set of paper or plural sets of paper by performing stapling operation for binding one location of plural stacked sheets by means of a staple, at one or multiple stapling positions selected from the plural stapling positions. The job is determined as a result of the operator operating a control panel prepared as a UI (user interface) of the system shown in FIG. 1 into which are integrated the image forming apparatus and the sheet processing apparatus.

Figure 7:
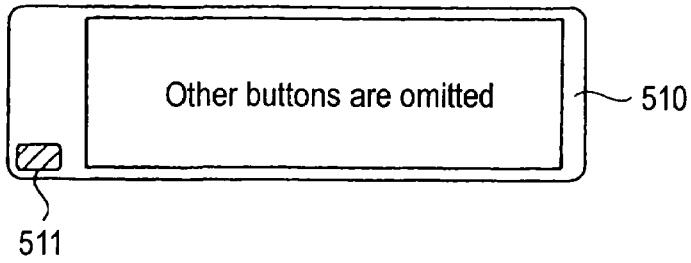
FIG. 7 is a view showing an initial screen of a liquid-crystal touch panel provided on a control panel.

FIG. 7 is a view showing an initial screen of a liquid-crystal touch panel provided at the control panel.

Of various buttons available on the liquid-crystal touch panel, a hatched button is a pressed (selected) button, and a button indicated by dotted lines is a button that cannot be selected.

By means of the initial screen 510 shown in FIG. 7, various specifying operations, such as specification of a paper size, specification of the density for forming an image, the number of copies, or the like, are performed. Operation buttons to be used for performing these operations are omitted here, and only a paper type selection button 511 provided at a lower left position on the screen is shown. This paper type selection button 511 is a button which does not need to be operated when plain paper is desired as a sheet to be subjected to image formation and transported to the sheet processing apparatus. Namely, when a sheet other than plain paper is desired, this button is to be operated.

Figure 8:
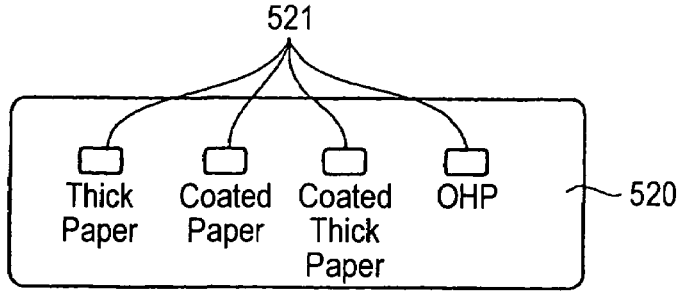
FIG. 8 is a view showing a paper type selection screen which appears from the initial screen when a paper type selection button shown in FIG. 7 is pressed.

FIG. 8 is a view showing a paper type selection screen which appears from the initial screen when the paper type selection button shown in FIG. 7 is pressed.

The operator selects a desired paper type from paper types (thick paper, coated paper, coated thick paper, and an OHP sheet) appearing on the paper type selection screen 520 shown in FIG. 8, and selects a paper type determination button 521 located at the position of the paper type.

Figure 9:
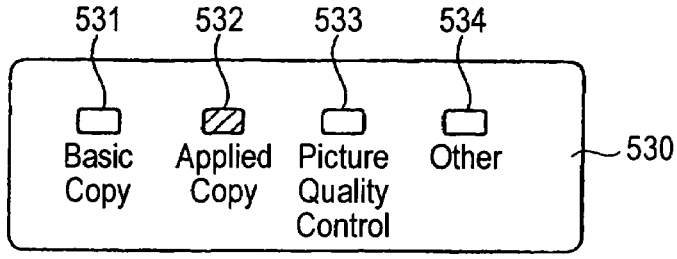
FIG. 9 is a view showing a basic setting screen which appears from the paper type selection screen shown in FIG. 8.

FIG. 9 is a view showing a basic setting screen which appears from the paper type selection screen shown in FIG. 8.

The operator presses a desired button among a basic copy button 531, an applied copy button 532, a picture quality control button 533, and an "other" button 534, all being provided in the basic setting screen 530 shown in FIG. 9. In order to perform stapling operation, the applied copy button 532 is pressed.

Figure 10:
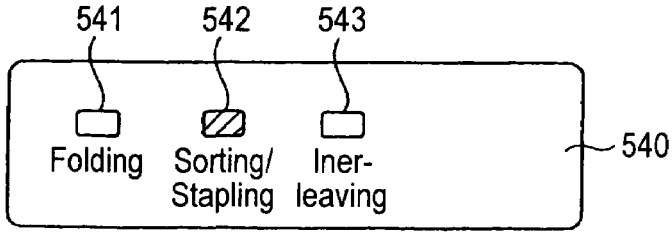
FIG. 10 is a view showing an applied copy selection screen which appears from the basic setting screen when the applied copy button shown in FIG. 9 is pressed.

FIG. 10 is a view showing an applied copy selection screen which appears from the basic setting screen when the applied copy button shown in FIG. 9 is pressed.

The operator presses a desired button from among a folding button 541, a sorting/stapling button 542, and an interleaving paper processing button 543, all belonging to the applied copy selection screen 540 shown in FIG. 10. In order to perform stapling operation, the sorting/stapling button 542 is pressed.

Figure 11:
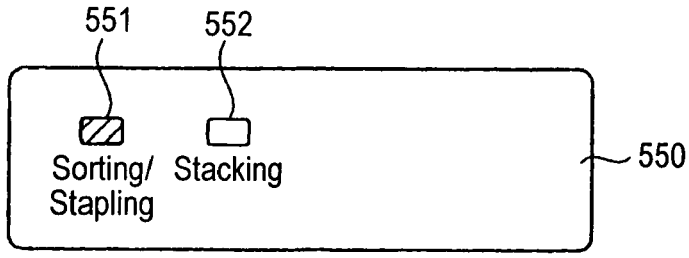
FIG. 11 is a view showing a detailed selection screen which appears from the applied copy screen when a sorting/stapling button shown in FIG. 10 is pressed.

FIG. 11 is a view showing a detailed selection screen which appears when the sorting/stapling button shown in FIG. 10 is pressed.

The operator presses either a sorting/stapling button 551 or the stacking button 552 in the detailed selection screen 550 shown in FIG. 11.

Figure 12:
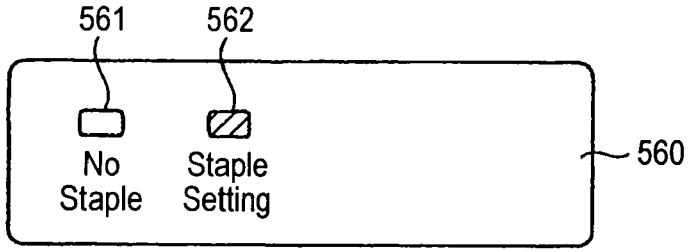
FIG. 12 is a view showing a staple necessary/unnecessary selection screen which appears from the detailed selection screen when a sorting/stapling button shown in FIG. 11 is pressed.

FIG. 12 is a view showing a stapling necessary/unnecessary selection screen which appears from the detailed selection screen when the sorting/stapling button shown in FIG. 11 is pressed.

When stapling operation is required to be performed, the operator presses a staple setting button 562 shown on the right side of the stapling necessary/unnecessary selection screen 560 shown in FIG. 12. When stapling operation is not required to be performed, the operator presses a staple setting unnecessary setting button 561 shown on the left side of the staple necessary/unnecessary selection screen.

Figure 13:
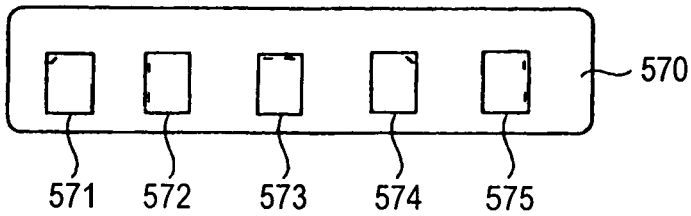
FIG. 13 is a view showing a staple position selection screen which appears from the staple necessary/unnecessary selection screen when the staple setting button shown in FIG. 12 is pressed.

FIG. 13 is a view showing a staple position selection screen which appears from the staple necessary/unnecessary selection screen when the staple setting button shown in FIG. 12 is pressed.

Two types of stapling modes; that is, a mode for providing single staple at a single corner, and a dual mode for providing two staples along a single edge, are set in the stapling device 10 of this embodiment. Two stapling positions are set for the single mode for stapling one corner. Specifically, when an icon button 571 assigned to the leftmost position of the stapling position selection screen 570 shown in FIG. 13 is pressed, stapling is performed at the stapling position identical with the staple discarding position. Moreover, when an icon button 574 assigned to the second position from the right in FIG. 13 is pressed, the sheet being transported toward the compile tray 105 shown in FIG. 2 is inverted, whereby the sheet is transported to the compile tray 105 shown in FIG. 2 while the edge of the sheet that before now has faced downstream in the transporting direction is now oriented upstream. The sheet is subjected to stapling at a position set on the R portion 1803 of the rail member 180 shown in FIG. 3 opposite the staple discarding position.

In the dual mode where two locations along a single edge are to be stapled, stapling positions vary according to the size of a sheet. In the stapling device 10 of this embodiment, two stapling positions are set in the linear portion 1801 of the rail member 180 shown in FIG. 3 for respective sheet sizes. An icon button 572 assigned to the second-left position of the stapling position selection screen 570 shown in FIG. 13 and an icon button 575 assigned to the rightmost position of the same screen are buttons to be used for specifying provision of two staples along a longitudinal edge of a sheet. When the icon button 575 shown in the rightmost position in FIG. 13 is pressed, the sheet being transported is inverted, whereby the sheet is transported to the compile tray 105 while the edge of the sheet that until now has faced downstream in the transporting direction is changed to face upstream. When the icon button 572 assigned to the second-left position is pressed, the sheet is transported to the compile tray 105 without inversion of the sheet being transported upside down. When either of these buttons is pressed, stapling is performed at the same stapling position. In the meantime, an icon button 573 provided in the center of the stapling position selection screen 570 is for specifying provision of two staples along a lateral edge of a sheet. When this button is pressed, two staples are provided at an interval smaller than that at which two staples are provided through the stapling operation that has been described so far. In the single mode and in the dual mode where staples are provided at positions along a longitudinal edge of the sheet, the sheet is transported to the compile tray 105 while being oriented in the lateral direction. However, in the dual mode where the staples are provided at positions along the lateral edge of the sheet, the sheet is transported while being oriented in the longitudinal direction. As mentioned above, in the stapling device 10 of this embodiment, provision of staples in the longitudinal or lateral edge is achieved by changing the transporting direction of a sheet and through use of the two stapling positions set in the linear portion 1801 of the rail member 180.

A job is determined by performing operations pertaining to the respective screens such as those described above. The control section 7 that performs control of the overall sheet processing apparatus 2, including control of the stapling device 10 shown in FIG. 1, acquires job information representing details of the determined job and performs processing which will be described below. In order to make descriptions brief and clear, descriptions will be provided below by taking, as an example, the case of a single mode where one corner is to be stapled.

The control section 7 performs operation for counting staple tip ends in the receiving section 163.

Figure 14:
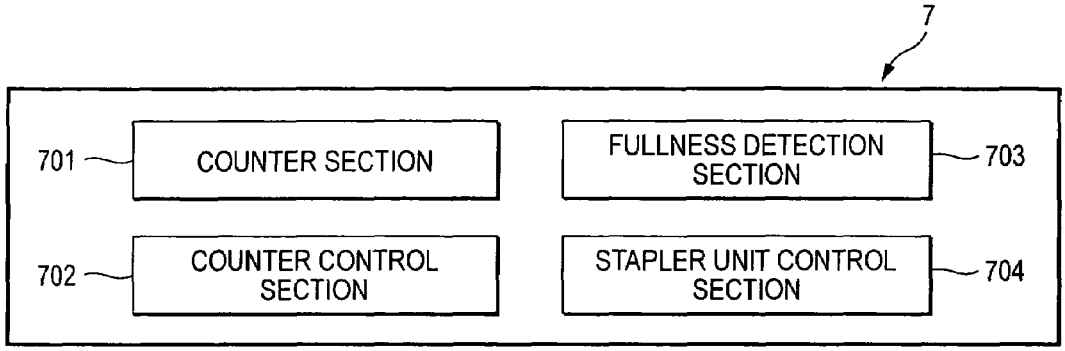
FIG. 14 is a functional block diagram showing a control section for performing operation for counting staple tip ends in a receiving section.

FIG. 14 is a functional block diagram showing a control section for performing operation for counting staple tip ends in the receiving section.

The control section 7 shown in FIG. 14 includes a counter section 701 for counting the number of stapling operations; a counter control section 702 for stopping counting operation of the counter 701 or resetting a count value of the counter 701; a fullness detection section 703 for detecting that the receiving section 163 is filled with staple tip ends, as a result of the count value of the counter 701 having exceeded a predetermined value; and a stapler unit control section 704 which moves the stapler unit 160 and determines the position thereof.

Figure 15:
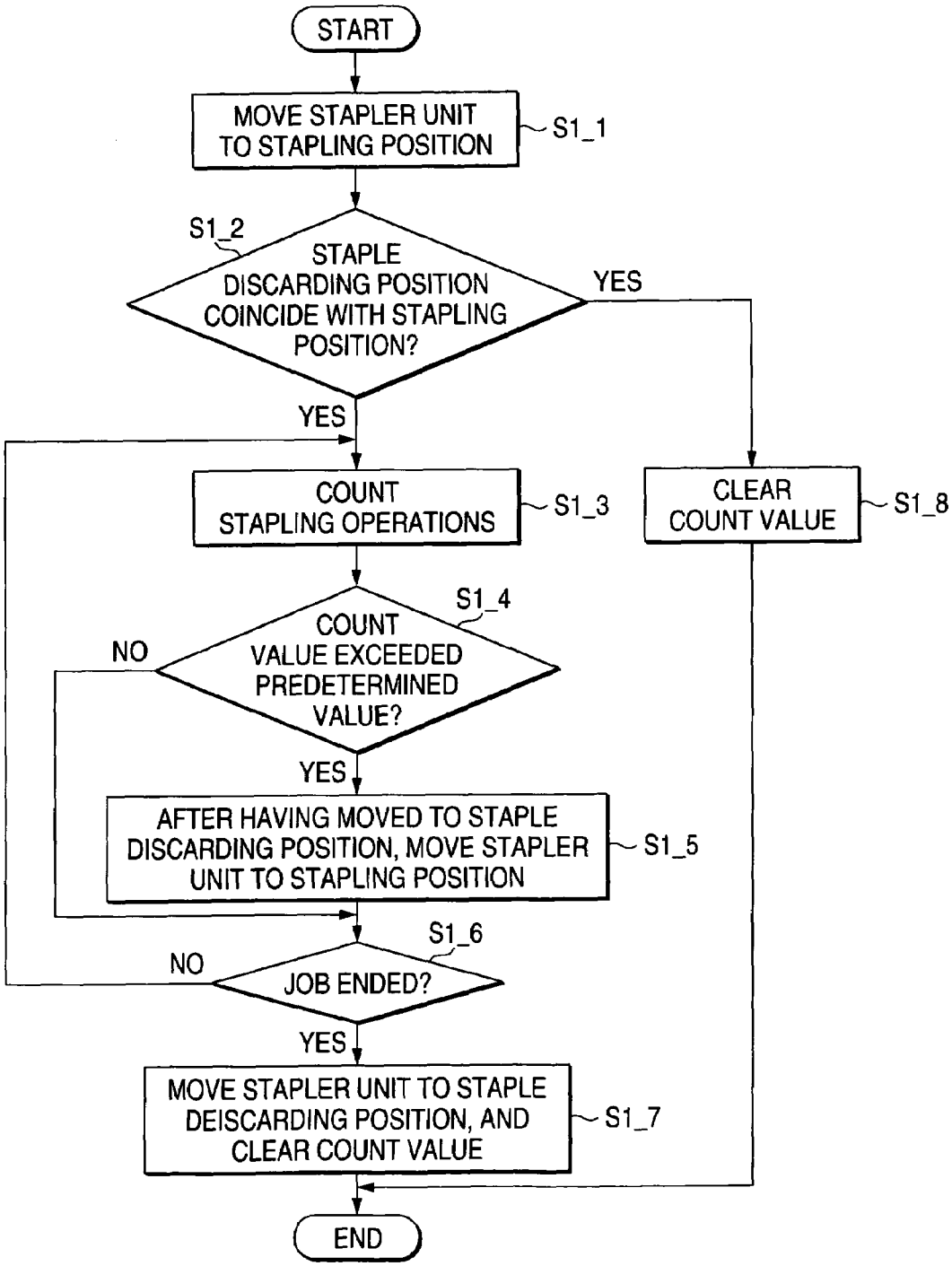
FIG. 15 is a flowchart of operation for counting staple tip ends in the receiving section, which is performed by the control section shown in FIG. 14.

FIG. 15 is a flow chart of operation for counting the number of staple tip ends in the receiving section, which is performed by the control section shown in FIG. 14.

The control section 7 shown in FIG. 14 acquires image formation start information indicating that the image forming apparatus 1 has started image formation operation on the basis of the acquired job. Upon receipt of this image formation start information, the control section 7 starts the staple tip end counting operation shown in FIG. 15.

The stapler unit 160 is first moved to the stapling position by reference to the job information (step S1_1), and a determination is made as to whether or not the stapling position to which the stapler unit has been moved is identical with the staple discarding position (step S1_2). Processing operations thus far are performed by the function of the stapler unit control section 704. When the stapling position is different from the staple discarding position (when No is selected), the number of stapling operations performed by the stapler unit 160 (the number of stapling operations) is counted at a point in time where the stapling operation detection sensor 167 shown in FIG. 2 has detected stapling operation of the stapling section 161 (step S1_3). This processing is performed by the function of the counter control section 702.

Subsequently, a determination is made as to whether or not the number acquired by counting the stapling operations has exceeded a predetermined value (step S1_4). When the count value has exceeded the predetermined value, processing proceeds to step S1_5. A round of processing operations is performed by the function of the fullness detection section 703. Here, the predetermined value used herein is a total number of stapling operations to be performed until the receiving section in an empty state is filled with staple tip ends. In step S1_5, after once having been moved to the staple discarding position, the stapler unit 160 is returned to the stapling processing position to which the stapler unit has been moved in step S1_1. Processing pertaining to step S1_5 is performed by the function of the stapler unit control section 704. The staple tip ends are discarded from the receiving section 163 of the stapler unit 160 that has once been moved to the staple discarding position. The stapler unit 160 whose receiving section 163 has become empty returns to the previous stapling position.

On the basis of the job information, a determination is made as to whether or not the job has been completed (step S1_6). When the job is to be continued (when No is selected), processing returns to step S1_3. In contrast, when the job has been completed (when Yes is selected), the stapler unit 160 is moved to the staple discarding position by means of the function of the stapler unit control section 704. Further, the count value pertaining to the number of stapling operations is cleared by the function of the counter control section 702 (step S1_7). Thus, the staple tip end counting operation is terminated. As mentioned above, the stapler unit 160 is moved to the staple discarding position at the time of end of the job. As a result, the receiving section 163 of the stapler unit 160 becomes empty at all times at the time of initiation of a job, thereby diminishing the possibility of the receiving section 163 becoming full during the course of the next job.

When, in step S1_2, the stapling position is determined to be identical with the staple discarding position, the count value is cleared by the function of the counter control section 702 (step S1_8), to thus complete the operation for counting the number of staple tip ends. When the stapling position is identical with the staple discarding position, the open-close cover 1632 shown in FIG. 6 remains open. The cut staple tip ends are collected by the staple recovery box 182 without being held in the receiving section 163. Therefore, counting of staple tip ends is not required, and the count value is cleared, to thus prepare for counting staple tip ends in the next job.

When the count value is determined to be the predetermined value or less in step S1_4, processing proceeds to step S1_6 where the determination is made as to whether or not the job has been completed.

According to the previously-described staple tip end counting operation, when the job does not include a command for performing stapling operation at the stapling position identical with the staple discarding position, the stapler unit is moved to the staple discarding position at the end of the job, thereby diminishing the possibility of overflow of staple tip ends from the receiving section 163. When the count value has exceeded the predetermined value, the chance of overflow of staple tip ends from the receiving section 163 is also diminished by moving the stapler unit 160 to the staple discarding position.

Subsequently, a stapling device of a second embodiment will be described. The stapling device of the second embodiment is equipped with a mechanism for detecting the thickness of a set of paper. Constituent elements which are the same as those of the stapling device of the first embodiment are assigned the same reference numerals, and the drawings that have been used for reference thus far are cited.

In the stapling device of the second embodiment, when a set of paper is discharged toward the exit tray 109, the thickness of the set of paper is detected by means of rotation of the eject roller 131 shown in FIG. 2.

Figure 16:
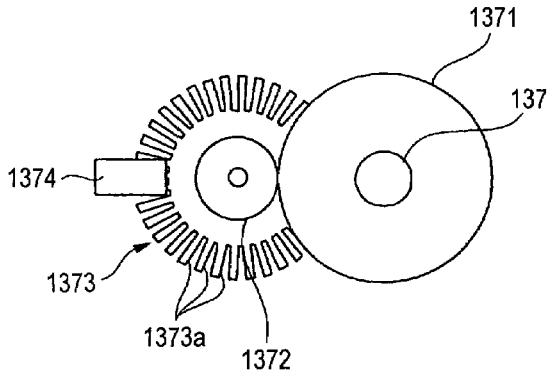
FIG. 16 is a view showing a mechanism for detecting the thickness of a set of paper, which is provided in a stapling device according to a second embodiment.

FIG. 16 is a view showing a mechanism for detecting the thickness of a set of paper provided in the stapling device of the second embodiment.

In addition to showing the rotation center shaft 137 shown in FIG. 2, FIG. 16 shows a driving gear 1371 attached to the rotary center shaft 137 and a driven gear 1372 meshing with the driving gear 1371. A disk 1373 in which are circumferentially formed plural slits 1373*a* is attached to the rotary shaft of the driven gear 1372. Further, a thickness detection sensor 1374 for detecting the slits 1373*a* of the disk 1373 is also shown. By utilization of a phenomenon of the number of rotations of the rotary center shaft 137 being changed by the thickness of the set of paper, the thickness detection mechanism shown in FIG. 16 rotates the disk 1373 by means of gear driving operation associated with rotation of the rotation center shaft 137. The thickness of the set of paper is detected by reference to the number of slits 1373*a* that are formed in the disk 1373 and pass by the thickness detection sensor 1374.

According to the stapling device 10 of the second embodiment, the operation for counting staple tip ends to be performed by the receiving section 163 according to the thickness of the detected thickness is performed by the control section.

Figure 17:
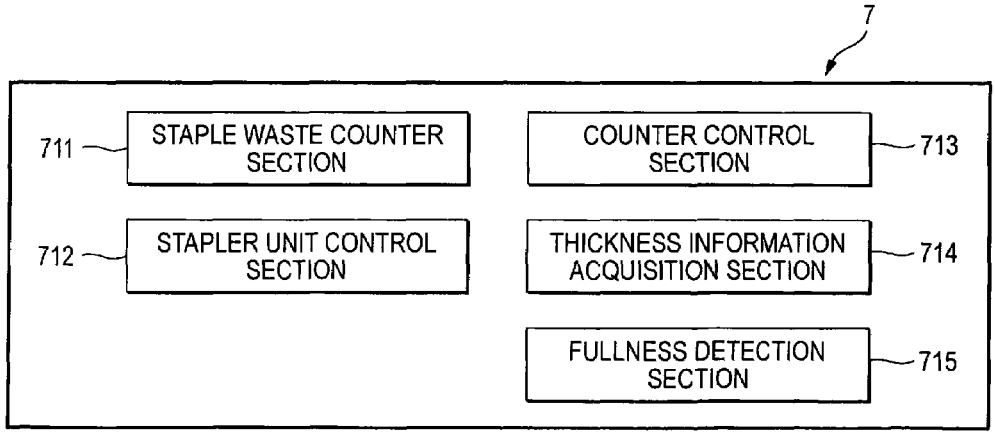
FIG. 17 is a functional block diagram showing a control section for performing operation for counting staple tip ends in a receiving section.

FIG. 17 is a functional block diagram showing the control section when the control section performs operation for counting the staple tip ends in the receiving section corresponding to the thickness of the set of paper.

The control section 7 shown in FIG. 17 includes a staple waste counter section 711 for counting the number of staple tip ends to be held in the receiving section while incrementing or decrementing a count value according to the thickness of a set of paper to be formed; a stapler unit control section 712 which moves the stapler unit 160 and determines the position thereof; a counter control section 713 for causing the staple waste counter section 711 to suspend counting operation or resume the same; a thickness information acquisition section 714 for acquiring thickness information indicating the thickness of paper transported; and a fullness detection section 715 for detecting that the receiving section 163 is filled with staple tip ends, as a result of the count value of the staple waste counter section 711 having exceeded the predetermined value.

Figure 18:
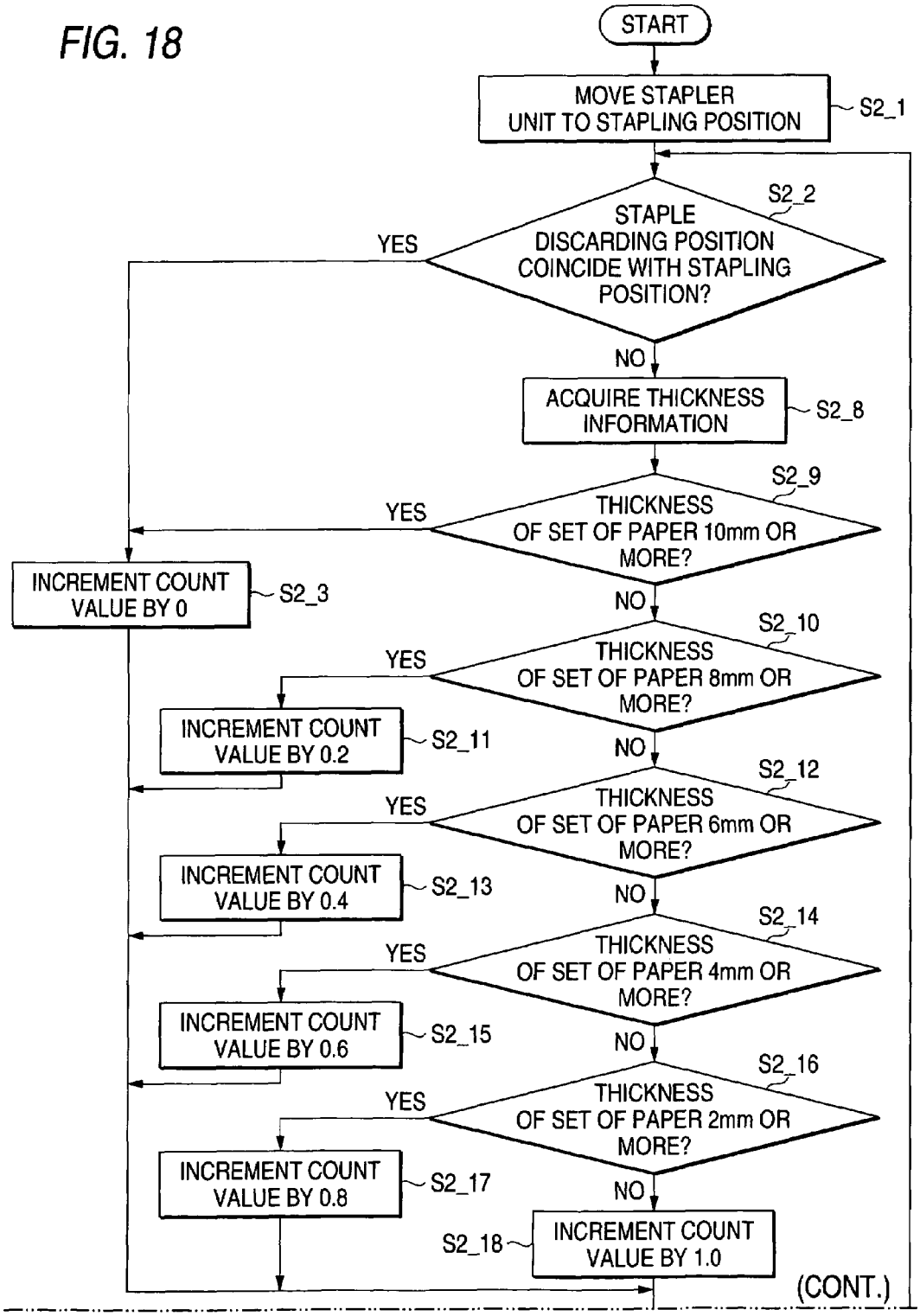
FIG. 18 is a flowchart of operation for counting staple tip ends in accordance with the thickness of a set of paper, which is performed by the control section shown in FIG. 17.

FIG. 18 is a flowchart of staple tip end counting operation corresponding to the thickness of a set of paper, which is performed by the control section shown in FIG. 17.

The control section 7 shown in FIG. 17 acquires the image formation start information as well as job information and commences staple tip end counting operation shown in FIG. 18 upon receipt of the image formation start information.

The stapler unit 160 is moved to the stapling position on the basis of the job information (step S2_1), and a determination is made as to whether or not the stapling position to which the stapler unit has been moved is identical with the staple discarding position (step S2_2). Processing operations thus far are performed by the function of the stapler unit control section 704. When the stapling position is identical with the staple discarding position (when Yes is selected), the number of stapling operations performed by the stapler unit 160 is incremented by a value of 1×0 at a point in time where the stapling operation detection sensor 167 shown in FIG. 2 has detected stapling operation of the stapling section 161 (step S2_3). In short, in step S2_3 the count value remains unchanged, and the counter control section 713 causes the staple waste counter section 711 to suspend counting operation. After processing pertaining to step S2_3 has been performed, a determination is made as to whether or not the number acquired by counting the stapling operations has exceeded a predetermined value (step S2_4). When the count value has exceeded the predetermined value, processing proceeds to step S2_5. A round of processing operations is performed by the function of the fullness detection section 715. Here, the predetermined value used herein is a total number of stapling operations to be performed until the receiving section, starting from an empty state, is filled with staple tip ends. In step S2_5, after having been moved to the staple discarding position, the stapler unit 160 is returned to the stapling processing position to which the stapler unit has been moved in step S2_1. Processing pertaining to step S2_5 is performed by the function of the stapler unit control section 712. The staple tip ends are discarded from the receiving section 163 of the stapler unit 160 that has once been moved to the staple discarding position. The stapler unit 160 whose receiving section 163 has become empty returns to the previous stapling position. Subsequently, on the basis of the job information, a determination is made as to whether or not the job has been completed (step S2_6). When the job has been completed (when Yes is selected), the stapler unit 160 is moved to the staple discarding position by means of the function of the stapler unit control section 712. Further, the count value pertaining to the number of stapling operations is cleared by the function of the counter control section 713 (step S2_7). Thus, the staple tip end counting operation is terminated. In contrast, when the job is to be continued (when No is selected), processing returns to step S2_2. When the count value is determined not to exceed the predetermined value through determination operation pertaining to step S2_4 (when No is selected), processing proceeds to step S2_6, where the determination is made as to whether or not the job has been completed.

When the stapling position is determined to be different from the staple discarding position (when No is selected) through determination of the stapling position pertaining to step S2_2, thickness information representing a detected thickness of the set of paper is acquired by means of the function of the thickness information acquisition section 714 (step S2_8), and processing from step S2_9 to step S2_18 is performed by the function of the staple waste counter section 711. Namely, a determination is made as to whether or not the thickness indicated by the thickness information is 10 mm or more (step S2_9). In a case where the thickness is 10 mm or more (when Yes is selected), processing proceeds to step S2_3 where the count value is incremented by 0 at a point in time when the stapling operation of the stapling section 161 is detected by the stapling operation detection sensor 167 shown in FIG. 2. In contrast, when the thickness is less than 10 mm (when No is selected), processing proceeds to step S2_10. In step S2_10, a determination is made as to whether or not the thickness indicated by thickness information is 8 mm or more. When the thickness is 8 mm or more (when Yes is selected), the count value pertaining to the number of stapling operations is incremented by 1×0.2 at a point in time when the stapling operation of the stapling section 161 is detected by the stapling operation detection sensor 167 shown in FIG. 2 (step S2_11), and processing proceeds to step S2_4. When the thickness is less than 8 mm (when No is selected), processing proceeds to step S2_12. In step S2_12, a determination is made as to whether or not the thickness indicated by the thickness information is 6 mm or more. When the thickness is 6 mm or more (when Yes is selected), the count value pertaining to the number of stapling operations is incremented by 1×0.4 at a point in time when the stapling operation of the stapling section 161 is detected by the stapling operation detection sensor 167 shown in FIG. 2 (step S2_13), and processing proceeds to step S2_4. When the thickness is less than 6 mm (when No is selected), processing proceeds to step S2_14. In step S2_14, a determination is made as to whether or not the thickness indicated by the thickness information is 4 mm or more. When the thickness is 4 mm or more (when Yes is selected), the count value pertaining to the number of stapling operations is incremented by 1×0.6 at a point in time when the stapling operation of the stapling section 161 is detected by the stapling operation detection sensor 167 shown in FIG. 2 (step S2_15), and processing proceeds to step S2_4. When the thickness is less than 4 mm (when No is selected), processing proceeds to step S2_16. In step S2_16, a determination is made as to whether or not the thickness indicated by the thickness information is 2 mm or more. When the thickness is 2 mm or more (when Yes is selected), the count value pertaining to the number of stapling operations is incremented by 1×0.8 at a point in time when the stapling operation of the stapling section 161 is detected by the stapling operation detection sensor 167 shown in FIG. 2 (step S2_17), and processing proceeds to step S2_4. When the thickness is less than 2 mm (when No is selected), the count value pertaining to the number of stapling operations is incremented by 1×1.0 at a point in time when the stapling operation of the stapling section 161 is detected by the stapling operation detection sensor 167 shown in FIG. 2 (step S2_18), and processing proceeds to step S2_4.

According to the staple tip end counting operation shown in FIG. 18, the number of staple tip ends corresponding to the thickness of a set of paper to be formed is counted, whereby the quantity of staple tip ends, which varies according to the thickness of a set of paper to be formed, can be accurately determined. Further, the stapler unit 160 can be moved to the staple discarding position at an appropriate timing, thereby minimizing a drop in productivity while reducing the chance of overflow of the staple tip ends from the receiving section 163. Moreover, the stapler unit 160 is moved to the staple discarding position at the end of the job, whereby the receiving section 163 becomes empty at the time of commencement of the next job, thereby minimizing a drop in productivity.

In the stapling device 10 of the second embodiment, the control section 7 also performs operation for counting the staple tip ends in the staple recovery box 182 according to the thickness of a set of paper.

Figure 19:
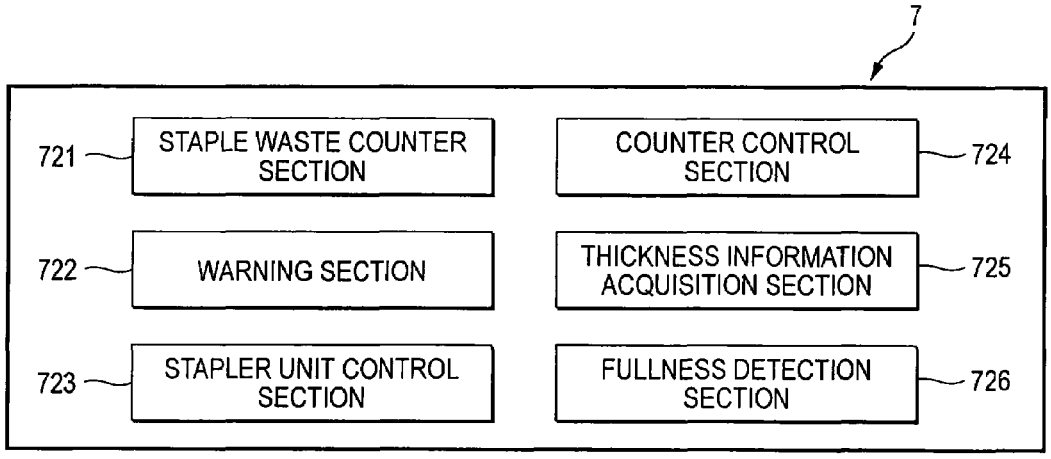
FIG. 19 is a functional block diagram showing a control section for performing operation for counting staple tip ends in a staple recovery box in accordance with the thickness of a set of paper.

FIG. 19 is a functional block diagram representing a control section when counting of staple tip ends in the staple recovery box corresponding to the thickness of a set of paper is performed.

The control section 7 shown in FIG. 19 includes a staple waste counter section 721 for counting staple tip ends to be held in the staple recovery box 182 while incrementing or decrementing a count value in accordance with the thickness of a set of paper to be formed; a warning section 722 for displaying a message when the count value indicated by the staple waste counter 721 has exceeded a predetermined value; a stapler unit control section 723 which moves the stapler unit 160 and determines the position thereof; a counter control section 724 for causing the staple waste counter 721 to suspend counting operation or resume the same; a thickness information acquisition section 725 for acquiring thickness information indicating the thickness of paper transported; and a fullness detection section 726 for detecting that the staple recovery box 182 is filled with staple tip ends, as a result of the count value of the staple waste counter section 721 having exceeded the predetermined value.

A limiting number of staple tip ends which can be held and the number of staple tip ends (a warning number) corresponding to 80% the limited number are set for the staple recovery box 185.

Figure 20:
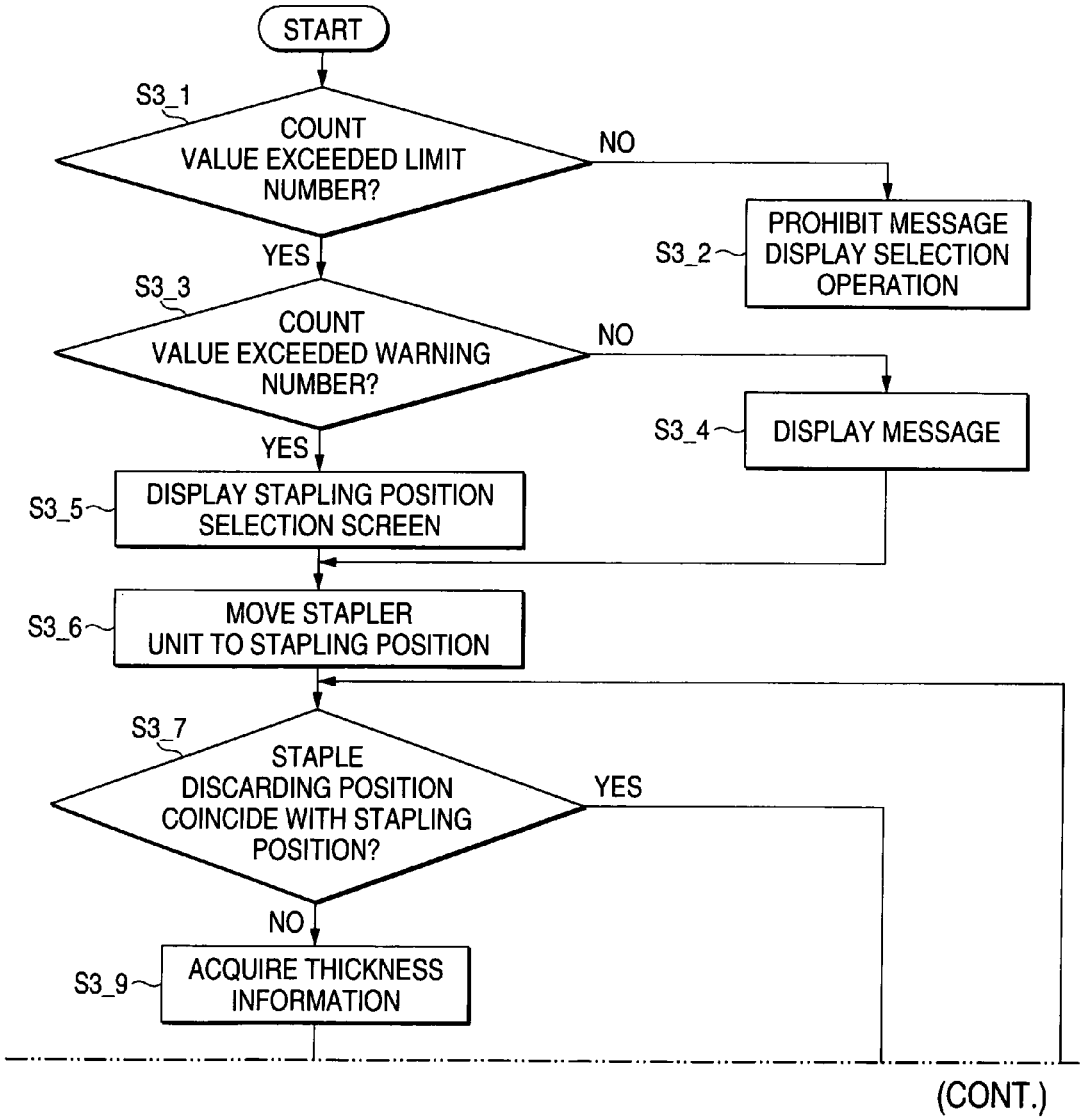
FIG. 20 is a flowchart of operation for counting staple tip ends in the staple recovery box in accordance with the thickness of a set of paper, which is performed by the control section shown in FIG. 19.

FIG. 20 is a flowchart of staple tip end counting operation corresponding to the thickness of a set of paper, which is performed by the control section shown in FIG. 19.

Even in the staple tip end counting operation shown in FIG. 20, the control section 7 shown in FIG. 19 counts staple tip ends. Unless the count value is cleared, the count value is stored even when the staple tip end counting operation has ended. In response to pressing of the staple setting button 562 on the staple necessary/unnecessary selection screen 560 shown in FIG. 12, the control section 7 commences the staple tip end counting operation.

First, a determination is made whether or not the stored count value exceeds the limiting number, by means of the function of the fullness detection section 726 (step S3_1). If the count value has exceeded the limiting number (when Yes is selected), a message is displayed by means of the function of the warning section 722, and operation for selecting a stapling position is inhibited (step S3_2).

Figure 21:
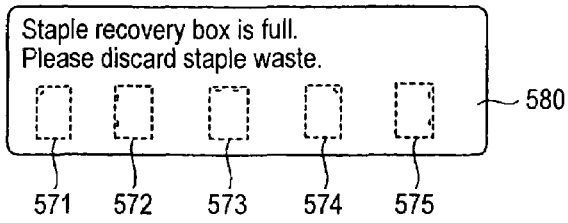
FIG. 21 is a view showing a screen displayed by means of processing pertaining to step S3_2 shown in FIG. 20.

FIG. 21 is a view showing a screen displayed by means of processing pertaining to step S3_2 shown in FIG. 20.

The screen 580 shown in FIG. 21 is analogous to the stapling position selection screen 570 shown in FIG. 13, but a message is displayed in an upper portion of the screen 580. Moreover, the icon buttons 571 to 575 assigned to the respective positions to be used for selecting stapling positions remain disabled. Therefore, operation for selecting a stapling position is prohibited, so that stapling operation cannot be performed. The staple recovery box 185 is removable, and is removed when the staple tip ends are discarded. The stapling device 10 of the second embodiment is provided with a removable detection sensor for detecting removal of the staple recovery box 185. In response to detection by the sensor of removal of the staple recovery box 185, the control section 7 switches the screen 580 shown in FIG. 21 to the staple position selection screen 570 and clears the count value.

In step S3_1, when the count value has not exceeded the limiting number (when No is selected), a determination is made as to whether or not the count value has exceeded the warning number (step S3_3). When the count value has exceeded the warning number (when Yes is selected), a message is displayed (step S3_4), and processing proceeds to step S3_6. When the count value has not exceeded the warning number, the stapling position selection screen 570 shown in FIG. 13 is displayed (step S3_5), and processing proceeds to step S3_6.

Figure 22:
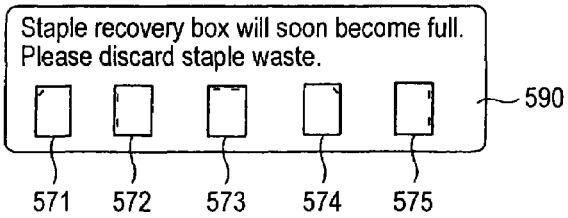
FIG. 22 is a view showing a screen displayed by means of processing pertaining to step S3_4 shown in FIG. 20.

FIG. 22 is a view showing a screen displayed by means of processing pertaining to step S3_4 shown in FIG. 20.

A warning message is displayed in the upper portion of the screen 590 shown in FIG. 22. In contrast with the case of the screen 580 shown in FIG. 21, the icon buttons 571 to 575 assigned to the respective positions to be used for selecting stapling positions are enabled. Therefore, stapling operation can be performed.

Processing from step S3_6 to step S3_19, which is described below, is identical with processing in the flowchart shown in FIG. 18, and hence its explanation is omitted. These processing operations are for counting staple tip ends while changing the size of the increment to the count value in accordance with the thickness of a set of paper.

In step S3_20, a determination is made, on the basis of the job information, as to whether or not the job has been completed. When the job is to be continued (when No is selected), processing returns to step S3_7. When the job has been completed (when Yes is selected), the staple tip end counting operation is terminated. Therefore, the count value pertaining to the staple tip ends is not cleared. When the staple tip end counting operation is commenced the next time, the count value obtained through the current counting operation is used.

Even in the staple tip end counting operation shown in FIG. 20, staple tip ends corresponding to the thickness of a set of paper to be formed or the number of sheets are counted. As a result, the amount of staple tip ends, which varies according to the thickness of a set of paper to be formed or the number of sheets, can be determined accurately. Moreover, discarding of the staple tip ends from the staple recovery box 182 can be reported at an appropriate timing, thereby minimizing a drop in productivity while reducing the chance of overflow of staple tip ends from the staple recovery box 182. Here, productivity is given precedence over overflow, and the job is continued even when the count value has reached a limiting number during the course of the job.

Subsequently, a stapling device of a third embodiment will be described. Even in this embodiment, constituent elements which are the same as those of the stapling device of the first embodiment are assigned the same reference numerals that have been used thus far, and the drawings that have been used for reference thus far are also cited.

According to the stapling device 10 of the third embodiment, operation for counting staple tip ends in the receiving section which varies according to the type of paper is performed. Specifically, the job information acquired by the control section 7 includes information about the type of paper selected by way of the paper type selection screen 520 shown in FIG. 8. The control section 7 performs operation for counting staple tip ends in the receiving section according to the type of paper, by utilization of the information about the type of paper.

Figure 23:
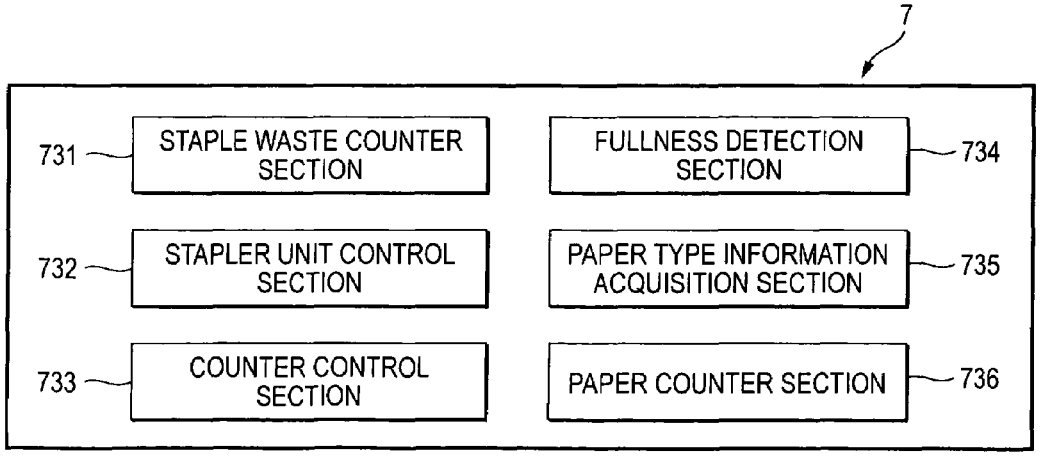
FIG. 23 is a functional block diagram showing a control section for performing operation for counting staple tip ends in the receiving section in accordance with the type of paper.

FIG. 23 is a functional block diagram showing a control section when the operation for counting staple tip ends in the receiving section according to the type of paper is performed.

The control section 7 shown in FIG. 23 includes a staple waste counter section 731 for counting the number of staple tip ends to be held in the receiving section while incrementing or decrementing a count value according to the thickness of a set of paper to be formed; a stapler unit control section 732 which moves the stapler unit 160 and determines the position of the stapler unit 160; a counter control section 733 for causing the staple waste counter section 731 to suspend counting operation or resume the same; a fullness detection section 734 for detecting that the receiving section 163 is filled with staple tip ends, from the count value of the staple waste counter section 731; a paper type information acquisition section 735 for acquiring paper type information representing the type of paper transported; and a paper count section 736 for counting the number of sheets of paper transported while incrementing or decrementing a count value on the basis of the paper type information acquired by the paper type information acquisition section 735.

Figure 24:
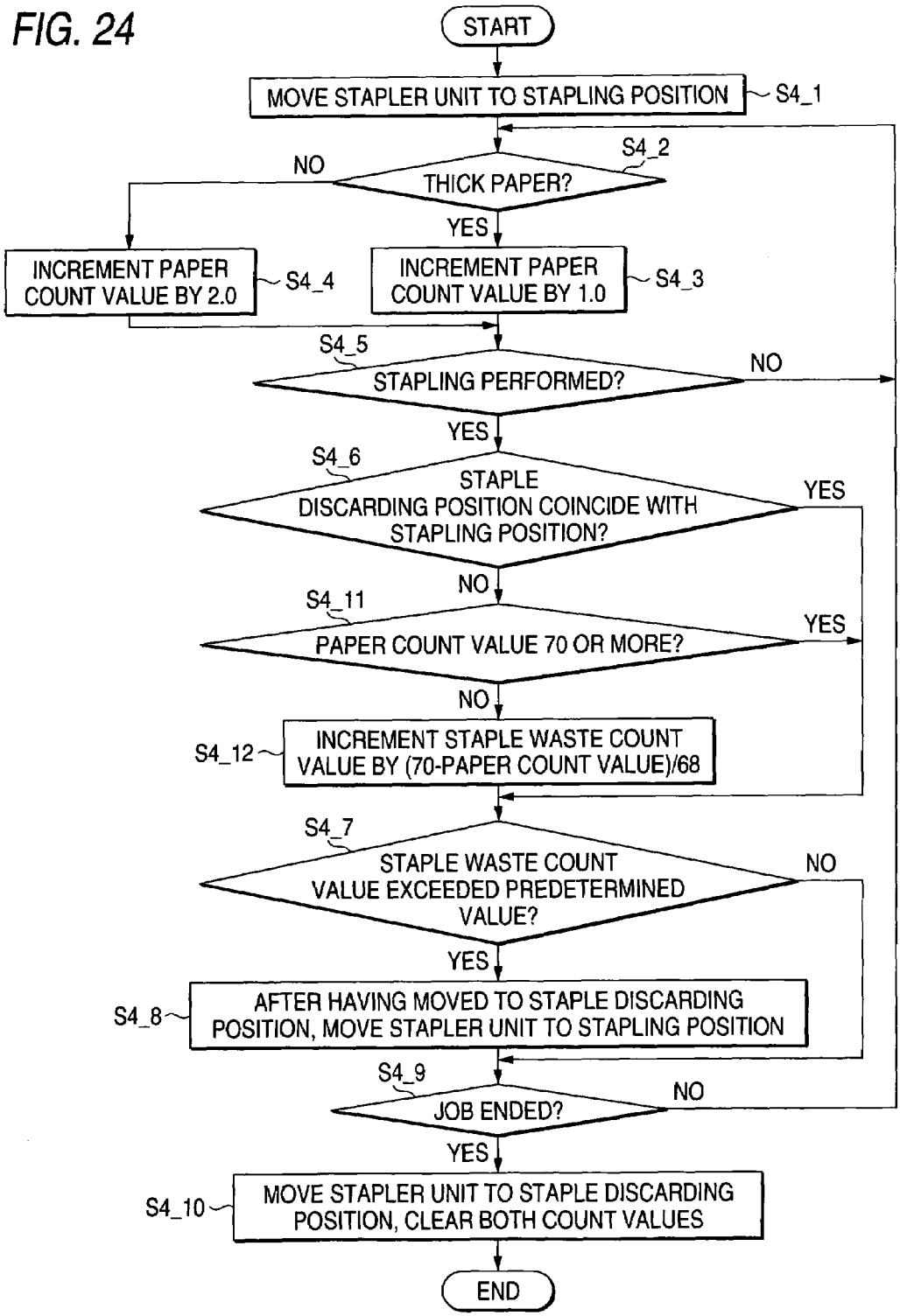
FIG. 24 is a flowchart of operation for counting staple tip ends in accordance with the type of paper, which is performed by the control section shown in FIG. 23.

FIG. 24 is a flowchart of staple tip end counting operation corresponding to the type of paper, which is performed by the control section shown in FIG. 23.

The control section 7 shown in FIG. 23 also acquires the image formation start information as well as job information and commences staple tip end counting operation shown in FIG. 24 upon receipt of the image formation start information.

The stapler unit 160 is moved to the stapling position on the basis of the job information by means of the function of the stapler unit control section 732 (step S4_1). Next, when transport of paper toward the compile tray 105 is detected by the compile exit sensor 103, a determination is made as to whether or not the paper transported to the compile tray 105 is thick paper, on the basis of the paper type information included in the acquired job information (step S4_2). Processing pertaining to step S4_2 is performed by the function of the paper type information acquisition section 735. If the paper type is not thick paper (when No is selected), the count value used for counting the number of sheets of paper placed on the compile tray 105 is incremented by 1×1.0 (step S4_3), and processing proceeds to step S4_5. In contrast, when the type of paper is thick paper (when Yes is selected), the count value pertaining to the number of sheets of paper is incremented by 1×2 (step S4_4), and processing proceeds to step S4_5. Processing subsequent to step S4_2 is performed by the function of the paper counter 736.

In step S4_5, the stapling detection sensor 167 shown in FIG. 2 determines whether or not the staple section 161 has performed stapling operation; that is, whether or not the stapler unit 160 has performed stapling operation. If the stapling operation has not yet been performed, processing returns to step S4_2. In contrast, when the stapling operation has been performed, a determination is made as to whether or not the stapling position for the performed stapling operation is identical with the staple discarding position, by means of the function of the stapler unit control section 732 (step S4_6). If the stapling position is identical with the staple discarding position (when Yes is selected), the staple waste count value used for counting the number of staple tip ends is not incremented, and a determination is made as to whether or not the staple waste counting value has exceeded a predetermined value (step S4_7). Suspension of incrementing of the staple waste count value used for counting the number of staple tip ends results in the counter control section 733 causing the staple waste counter section 731 to suspend counting operation. In contrast, when the staple waste count value has exceeded the predetermined value, processing proceeds to step S4_8. Flow of processing to step S4_8 is realized by the function of the fullness detection section 734. The predetermined value used herein is the maximum number of staple tip ends which can be held in the receiving section. In step S4_8, after having been moved to the staple discarding position, the stapler unit 160 is returned to the stapling processing position to which the stapler unit has been moved in step S4_1. Processing pertaining to step S4_8 is performed by the function of the stapler unit control section 732. The staple tip ends are discarded from the receiving section 163 of the stapler unit 160 that has been moved to the staple discarding position. The stapler unit 160 whose receiving section 163 has become empty returns to the previous stapling position. Subsequently, on the basis of the job information, a determination is made as to whether or not the job has been completed (step S4_9). When the job has been completed (when Yes is selected), the stapler unit 160 is moved to the staple discarding position by means of the function of the stapler unit control section 732. The count value pertaining to the number of paper is cleared, and the staple waste count value is also cleared by the function of the counter control section 733 (step S4_10). Thus, the staple tip end counting operation is terminated. In contrast, when the job is to be continued (when No is selected), processing returns to step S4_2. When the count value is determined not to exceed the predetermined value through determination operation pertaining to step S4_7 (when No is selected), processing proceeds to step S4_9, where the determination is made as to whether or not the job has been completed.

When the stapling position is determined to be different from the staple discarding position (when No is selected) through the determination pertaining to step S4_6, a determination is made as to whether or not the count value pertaining to the number of sheets of paper is 70 or more (step S4_11). When the count value pertaining to the number of paper is 70 or more (when Yes is selected), processing proceeds to step S4_7 without involvement of increment of the count value pertaining to staple tip ends. Even in this case, suspension of incrementing of the staple waste count value used for counting the number of staple tip ends results in the counter control section 733 causing the staple waste counter section 731 to suspend counting operation. When the count value pertaining to the number of sheets of paper is 70 or more, the tip ends of a staple are not cut, and hence increment of the staple waste count value is not necessary. In contrast, when the count value pertaining to the number of paper is less than 70 (when No is selected), the staple waste count value is incremented by a value of (70—a paper count value)/68 (step S4_12), and processing proceeds to step S4_7. In step S4_12, when the paper count value is 69, the staple waste count value is incremented by 0.01. When the paper count value is 35, the staple waste count value is incremented by 0.51. When the paper count value is 2, the staple waste count value is incremented by 1.00. Such processing pertaining to step S4_12 is performed by the function of the staple waste counter section 731.

According to the staple tip end counting operation shown in FIG. 24, the number of sheets to be form the sets is counted in consideration of whether the paper is thick paper, whereby the amount of staple tip ends, which varies according to the number of sheets to form the sets, can be determined accurately. Further, the stapler unit 160 can be moved to the staple discarding position at an appropriate timing, and hence a drop in productivity can be minimized while the chance of overflow of staple tip ends in the receiving section 163 is reduced. Moreover, the stapler unit 160 is moved to the staple discarding position at the end of the job, and hence the receiving section 163 becomes empty at the time of initiation of the next job, thereby further minimizing a drop in productivity.

In the stapling device 10 of the third embodiment, the control section causes the staple recovery box to count staple tip ends according to the type of paper.

Figure 25:
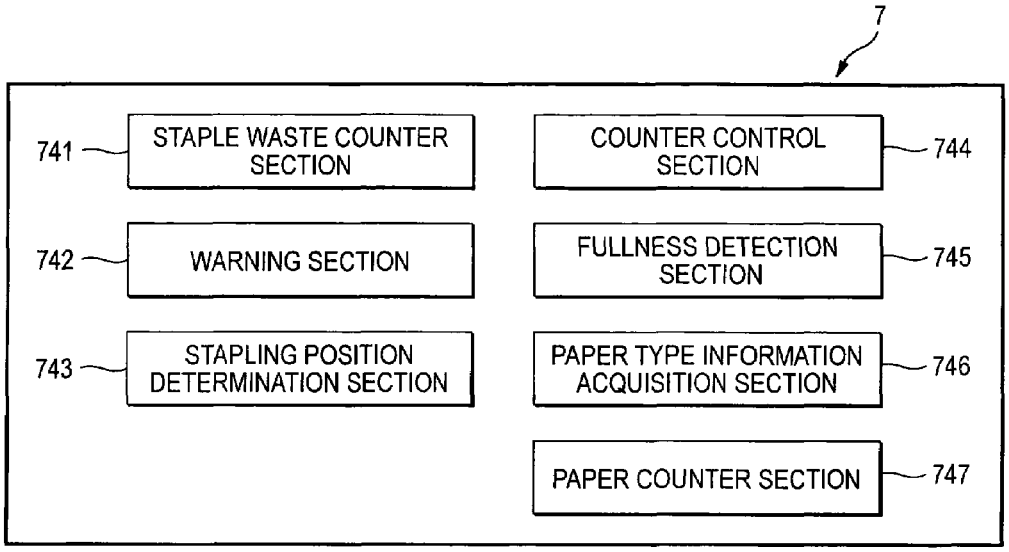
FIG. 25 is a functional block diagram showing a control section for performing operation for counting staple tip ends in the staple recovery box in accordance with the type of paper.

FIG. 25 is a functional block diagram showing a control section when operation for counting the number of staple tip ends in the staple recovery box according to the type of paper is performed.

The control section 7 shown in FIG. 25 includes a staple waste counter section 741 which counts staple tip ends held in the staple recovery box 182, by means of incrementing or decrementing a count value according to the number of sheets to form the sets; a warning section 742 which displays a message when the count value determined by the staple waste counter 721 has exceeded a predetermined value; a stapling position determination section 743 for determining the position of the stapler unit 160; a counter control section 744 which causes the staple waste counter 741 to suspend or resume counting operation or to clear a count value; a fullness detection section 745 for detecting that the staple recovery box 182 is filled with staple tip ends, from the count value of the staple waste counter section 741; a paper type information acquisition section 746 for acquiring paper type information indicating the type of paper transported; and a paper counter 747 for counting the number of sheets of paper transported, by incrementing or decrementing a count value on the basis of the paper type information acquired by the paper type information acquisition section 745.

A limiting number (a limit number) of staple tip ends which can be held and the number of staple tip ends (a warning number) corresponding to 80% the limited number are set for the staple recovery box 182 of the stapling device 10 of the third embodiment.

Figure 26:
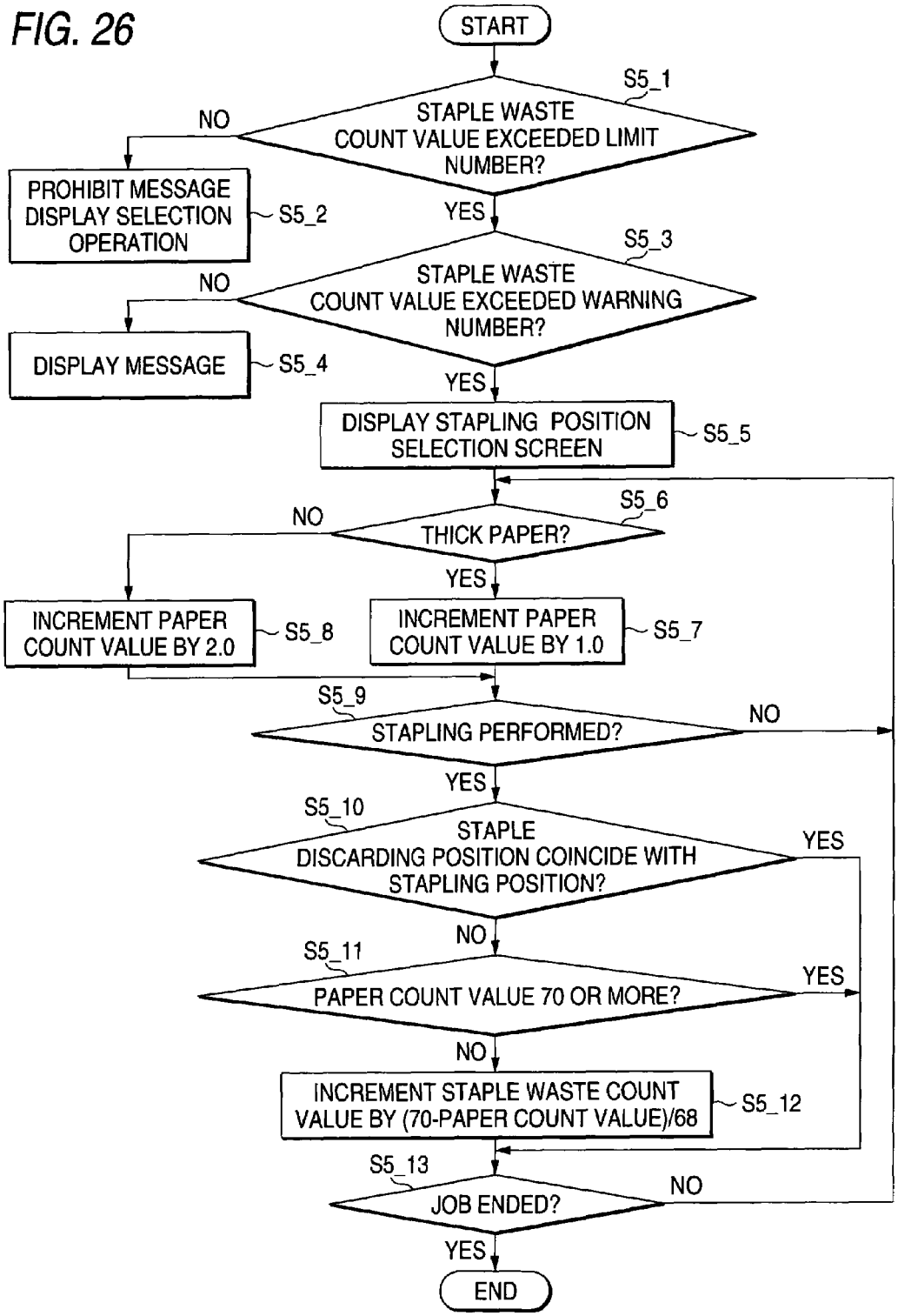
FIG. 26 is a flowchart of operation for counting staple tip ends in the staple recovery box in accordance with the type of paper, which is performed by the control section shown in FIG. 25.

FIG. 26 is a flowchart of operation for counting staple tip ends in the staple recovery box according to the type of a paper, which is to be performed by the control section shown in FIG. 25.

The control section 7 shown in FIG. 25 counts the staple tip ends through the staple tip end counting operation shown in FIG. 26. Unless the staple waste count value is cleared, the staple waste count value is stored even after the staple tip end counting operation is completed. In response to pressing of the staple setting button 562 on the staple necessary/unnecessary selection screen 560 shown in FIG. 12, the control section 7 starts staple tip end counting operation.

Processing from step S5_1 to S5_4 shown in FIG. 26 is identical with processing from step S3_1 to S3_4 shown in FIG. 20, and hence repeated explanation thereof is omitted. The processing is for displaying a message in accordance with the stored staple waste count value.

Processing from step S5_6 to S5_12 is identical with the counterpart processing in the flowchart shown in FIG. 24, and hence repeated explanation thereof is also omitted. The processing is for counting up the number of sheets of paper while changing the increment in the paper count depending on whether or not the paper is thick paper, and determining the staple waste count value on the basis of the count value.

In step S5_13, a determination is made as to whether or not the job has been completed, on the basis of the job information. When the job is to be continued (when No is selected), processing returns to step S5_6. When the job has been completed (when Yes is selected), the staple tip end counting operation is terminated. Therefore, the staple waste count value is not cleared, and the staple waste count value at this time is used when the staple tip end counting operation is started the next time.

Even in the staple tip end counting operation shown in FIG. 26, the amount of staple tip ends, which changes according to the number of sheets to form the sets, can be accurately determined by counting the number of sheets to form the sets in consideration of thick paper. Further, discarding of staple tip ends from the staple recovery box 182 can be reported at an appropriate timing, thereby minimizing the possibility of overflow of staple tip ends from the staple recovery box 182 and a drop in productivity.

A stapling operation of a fourth embodiment will now be described. Even in this embodiment, constituent elements which are the same as those of the stapling device of the first embodiment are assigned the same reference numerals that have been used thus far, and the drawings that have been used for reference thus far are also cited.

Although the previously-described stapling devices of the respective embodiments count the staple tip ends held in the receiving section 163 through use of the control section 7, the receiving section 163 in the stapling device of this embodiment is provided with a fullness detection sensor for detecting the receiving section 163 being filled with staple tip ends.

Figure 27:
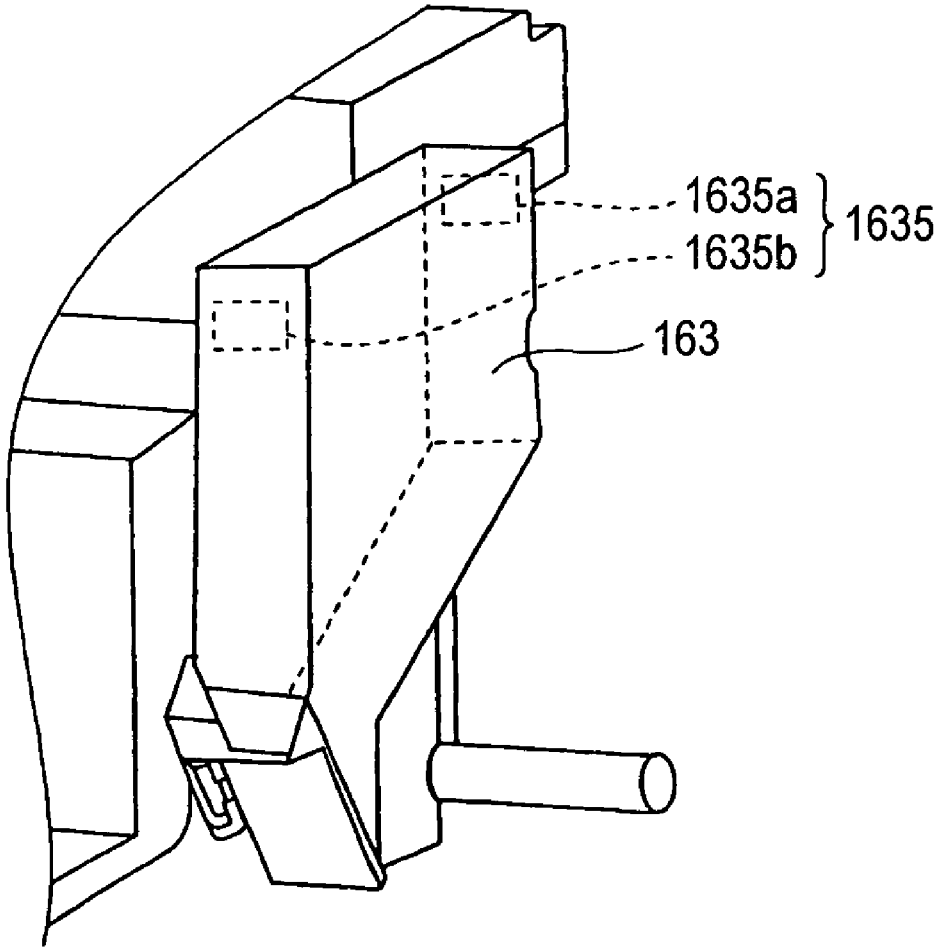
FIG. 27 is a view showing a receiving section of a stapling device according to a fourth embodiment.

FIG. 27 is a view showing a receiving section of the stapling device of the fourth embodiment.

A fullness detection sensor 1635 is shown in the receiving section 163 shown in FIG. 27. The fullness detection sensor 1635 has a phototransmission section 1635*a* and a light-receiving section 1635*b*. As a result of staple tip ends being stored in the receiving section 163 to thus block the light emitted from the phototransmission section 1635*a*, the light-receiving section 1635*b* detects that the receiving section 163 is filled with the staple tip ends. On the basis of the detection result output from the fullness detection sensor 1635, the control section 7 moves the stapler unit 160 to the staple discarding position.

A stapling device of a fifth embodiment will now be described. Even in this embodiment, constituent elements which are the same as those of the stapling device of the first embodiment are assigned the same reference numerals that have been used thus far, and the drawings that have been used this far for reference are also cited.

In the stapling device of this embodiment, a set of paper output to the exit tray 109 is counted by rotation of an eject motor. This stapling device is provided with a limit mode where formation of a set of paper is interrupted when the number of paper sets stacked on the exit tray 109 has reached a maximum number. Moreover, the stapling device is also provided with a limit-cancel mode where, even when the number of paper sets placed on the exit tray 109 has reached the maximum number, formation of a set of paper is continued. These modes are switched by operating an unillustrated mode changeover button provided in the initial screen 510 shown in FIG. 7. Overflow of staple tip ends from the receiving section 163 can be prevented by the limit mode, and a drop in productivity is prevented by the limit-cancel mode. However, in the limit-cancel mode, overflow of staple tip ends arises in the receiving section 163. Hence, the control section 7 monitors stapling operation of the staple section 161 by means of the staple detection sensor 167 shown in FIG. 2. In the limit-cancel mode, when stapling operation is performed a predetermined number of times or more during the course of a single job, the stapler unit 160 is once moved to the staple discarding position after ejection of a set of paper but before formation of another set of paper. Subsequently, the stapler unit is returned to the selected stapling position. The term "predetermined number of times" denotes the number of stapling operations required to form a maximum number of paper sets assumed in the dual mode. Even in the course of such a job, the stapler unit 160 is temporarily moved to the staple discarding position during a period in which stapling operation is not performed until sheets for the next set are accumulated. Thus, a drop in productivity is minimized, and the possibility of overflow of staple tip ends from the receiving section 163 is reduced. At this time, a message for prompting removal of the set of paper from the exit tray 109 may be issued.

In the image forming apparatus shown in FIG. 1, the smaller the size of paper, the shorter an image formation interval. Further, an interval at which the pair of transport rollers 104 shown in FIG. 2 sends paper to the compile tray 105 also becomes shorter. The job information includes paper size information representing the size of paper. When paper equal to or smaller than a predetermined size is sent by the pair of transport rollers 104, the control section 7 controls driving of the pair of transport rollers 104 on the basis of this paper size information, to thus delay a feed timing of the first sheet for the next set of paper, until the stapler unit 160 moves to the staple discarding position as a result of the stapling operation having been performed a predetermined number of times or more during the course of a single job and returns to the stapling position. This makes the timing at which all sheets to be subjected to stapling are prepared coincident with a return timing of the stapler unit 160, thereby effecting smooth stapling. The control section 7 may make an image formation interval of the image forming apparatus 1 shown in FIG. 1 longer, to thus reduce a transport pitch in the image forming apparatus 1, thereby delaying a timing at which the first sheet for the next set of paper is to be fed.

Various modes of the stapling device other than those described thus far will be described.

The staple recovery box 182 may also be provided with a fullness detection sensor, such as that shown in FIG. 27, and may display the screen 580 shown in FIG. 21 upon receipt of the detection result of the fullness detection sensor. A detection sensor may be disposed at a position lower than the fullness detection sensor, and the screen 590 shown in FIG. 22 may be displayed. Moreover, even when the detection sensor disposed at a position lower than the fullness detection sensor is activated, display of a warning message may be suspended until the stapler unit 160 reaches the staple discarding position. When the stapler unit 160 has reached the staple discarding position, the warning message may be displayed even during the course of a job.

As described above with reference to the embodiments, according to a first aspect, there is provided a stapling device including: a stapler unit that travels over a path including a staple discarding position and plural stapling positions, the stapler unit including: a staple section that performs stapling operation for binding plural stacked sheets with a staple; a cutter section that cuts tip ends of the staple to be used for binding the sheets; and a receiving section that receives the tip ends cut by the cutter; a staple recovery box disposed at the staple discarding position and recovers the tip ends received by the receiving section; and a staple discarding mechanism that discards the tip ends received in the receiving section from the stapler unit into the staple recovery box, wherein one of the plural stapling positions is identical with the staple discarding position.

According to the stapling device of the first aspect, one of the plural stapling positions is identical with the staple discarding position. When stapling operation is performed at the stapling position identical with the staple discarding position, the tip ends of staples held in the receiving section are discarded into the recovery box. Therefore, the stapling device can discard tip ends of staples without involvement of a decrease in productivity. Thus, both a decrease in the possibility of occurrence of overflow of the tip ends of staples from the receiving section and minimization of a drop in productivity are achieved.

In the stapling device, the stapling position may be identical with the staple discarding position as a stapling position where an upper left point of A4-size paper is bound by a staple, in which plural horizontally-oriented character strings are arranged on the sheet in form of plural lines in a longitudinal direction of the sheet.

The stapling position located at an upper left position on the sheet is a position that is most often used as the stapling position. As a result of the position coinciding with the staple discarding position, the tip ends of staples can be discarded frequently, thereby diminishing possibility of occurrence of overflow of the tip ends of the staples from the receiving section.

In the stapling device, the stapling device may form a set of sheets in accordance with a job that directs the stapling operation to be performed at one or plural stapling positions selected from the plural stapling positions to form one or plural sets of sheets, and the stapling device may further include a stapler unit control section that controls the stapler unit to move to the staple discarding position at the time of completion of the job when the job does not include a command for performing stapling operation at the stapling position identical with the staple discarding position.

According to this configuration, the tip ends of the staple are discarded at least once before the next job is commenced. Hence, possibility of occurrence of overflow of the tip ends of the staples from the receiving section is diminished further.

The stapling device may further include a fullness detection sensor that detects whether or not the receiving section is fully filled with tip ends of staples, and a stapler unit control section that controls the stapler unit to move to the staple discarding position when the fullness detection sensor detects that the receiving section is fully filled.

The stapling device may further include a counter that counts a number of the stapling operations performed, a counter control section that resets the number counted by the counter when the stapling operation is performed at a stapling position identical with the staple discarding position, a fullness detection sensor that detects that the receiving section is fully filled with tip ends of staples when the number counted by the counter exceeds a predetermined number, and a stapler unit control section that controls the stapler unit to move to the staple discarding position when the fullness detection sensor detects that the receiving section is fully filled.

Accordingly, overflow of tip ends from the receiving section can be prevented.

According to the above aspect, there can be provided a stapling device which achieves both a decrease in possibility of overflow of tip ends of a staple from a receiving section and minimization of a drop in productivity.

According to a second aspect, there is provided a stapling device including: a stapler unit that travels over a path including a staple discarding position and plural stapling positions, the stapler unit including: a staple section that performs stapling operation for binding plural stacked sheets with a staple to form a set of sheets, the sheets stacked as result of being sequentially fed; a cutter section that cuts tip ends of the staple to be used for binding the sheets; and a receiving section that receives the tip ends cut by the cutter; a staple recovery box disposed at the staple discarding position and recovers the tip ends received by the receiving section; a staple discarding mechanism that discards the tip ends received in the receiving section from the stapler unit into the staple recovery box; and a tray that accumulates a number of the set of sheets that are sequentially ejected every time the set of sheets is formed, the tray being configured a maximum number of sets of sheets to be carried, wherein the stapling unit forms the set of sheets in accordance with a job that directs the stapling operation to be performed at one or plural stapling positions selected from the plural stapling positions to form one or plural sets of sheets, and wherein the receiving section has a volume greater than a volume for holding all of tip ends cut from staples of a number required to obtain the maximum number of sets of sheets formed by stapling plural stacked sheets with staples at a maximum selectable number of the stapling positions.

When sets of stapled sheets are piled up, stapled portions of the sets are bowed upward, and the thus-piled sets of sheets finally collapse. Therefore, the maximum number of sets of sheets to be carried is set for the exit tray in order to prevent collapse of the sets of sheets. According to the stapling device of the present invention, the volume of the receiving section is determined while the maximum number of sets of sheets to be carried by the tray is taken as a guideline.

The stapling device may further include a control section that controls to perform the stapling operation in one of a limit mode and a limit cancellation mode, the limit mode for suspending formation of the set of sheets after the number of sets of sheets accumulated on the tray has reached the maximum number of sets of sheets, and the limit cancellation mode for continuing formation of the set of sheets after the number of sets of sheets accumulated on the tray has reached the maximum number of sets of sheets, wherein the control section, when the stapling operation is performed a predetermined number of times in the limit cancellation mode during one job, controls the stapler unit to temporarily move to the staple discarding position after ejection of the set of sheets and before formation of the next set of sheets, and subsequently controls the stapler unit to return to the selected stapling position.

Occurrence of overflow of tip ends of staples from the receiving section can be prevented by provision of the limit mode, and deterioration of productivity is prevented by provision of the limit cancellation mode. However, in the limit cancellation mode, overflow of the tip ends from the receiving section may arise. Therefore, the timing for discarding staple tip ends is set for a period of time during which stapling operation is not performed until the next sheets are piled up even when the period arises in the course of a job. Thus, deterioration of productivity can be minimized.

The stapling device may further include a sheet feeding device that sequentially feeds sheets at shorter time intervals as the sheets become smaller in size, wherein when the stapling operation is performed in the limit cancellation mode and a sheet of a predetermined size or smaller is fed by the sheet feeding device, the control section controls the sheet feeding device to delay a timing for feeding a first sheet of the next set of sheets, during the control of the stapler unit to temporarily move to the staple discarding position and to return to the selected stapling position.

Accordingly, the timing at which sheets to be stapled are all present coincides with a timing at which the stapler unit returns, so that smooth stapling is performed.

According to the above aspect, there can be provided a stapling device equipped with a receiving section of suitable volume.

Although the present invention has been shown and described with reference to specific embodiments, various changes and modifications will be apparent to those skilled in the art from the teachings herein. Such changes and modifications as are obvious are deemed to come within the spirit, scope and contemplation of the invention as defined in the appended claims.

The entire disclosures of Japanese Patent Applications Nos. 2004-214456 and 2004-214457 both filed on Jul. 22, 2004, each including specification, claims, drawings and abstract, are incorporated herein by reference in their entirety.

What is claimed is:

1. A stapling device comprising:

a stapler unit that travels over a path including a staple discarding position and a plurality of stapling positions, the stapler unit including:

a staple section that performs stapling operation for binding a plurality of stacked sheets with a staple;

a cutter section that cuts tip ends of the staple to be used for binding the sheets; and a receiving section that receives the tip ends cut by the cutter;

the stapling device further comprising:

a fullness detection sensor that detects whether or not the receiving section is fully filled with tip ends of staples;

a stapler unit control section that controls the stapler unit to move to the staple discarding position when the fullness detection sensor detects that the receiving section is fully filled;

a staple recovery box disposed at the staple discarding position and recovers the tip ends received by the receiving section; and a staple discarding mechanism that delivers the tip ends received in the receiving section of the stapler unit to the staple recovery box, wherein one of the plurality of stapling positions is identical with the staple discarding position.

2. The stapling device according to claim 1, wherein the stapling position identical with the staple discarding position is a stapling position where an upper left point of A4-size sheet is bound by a staple, in which a plurality of horizontally-oriented character strings are arranged on the sheet in the form of a plurality of lines in a longitudinal direction of the sheet.

3. The stapling device according to claim 1, wherein the stapling device forms a set of sheets in accordance with a job that directs the stapling operation to be performed at one or a plurality of stapling positions selected from the plurality of stapling positions to form one or a plurality of sets of sheets, and wherein the stapling device further comprises a stapler unit control section that controls the stapler unit to move to the staple discarding position at the time of completion of the job when the job does not include a command for performing stapling operation at the stapling position identical with the staple discarding position.

4. The stapling device according to claim 1, further comprising:

a counter that counts a number of the stapling operations performed;

a counter control section that resets the number counted by the counter when the stapling operation is performed at a stapling position identical with the staple discarding position;

a fullness detection sensor that detects that the receiving section is fully filled with tip ends of staples when the number counted by the counter exceeds a predetermined number; and a stapler unit control section that controls the stapler unit to move to the staple discarding position when the fullness detection sensor detects that the receiving section is fully filled.

5. The stapling device according to claim 1, wherein the stapling unit forms the set of sheets in accordance with a job that directs the stapling operation to be performed at one or a plurality of stapling positions selected from the plurality of stapling positions to form one or a plurality of sets of sheets.

6. The stapling device according to claim 5, further comprising a tray that accumulates a number of the set of sheets that are sequentially ejected every time the set of sheets is formed, the tray being configured a maximum number of sets of sheets to be carried, wherein the receiving section has a volume greater than a volume for holding all of tip ends cut from staples of a number required to obtain the maximum number of sets of sheets formed by stapling a plurality of stacked sheets with staples at a maximum selectable number of the stapling positions.

7. The stapling device according to claim 6, further comprising a control section that controls to perform the stapling operation in one of a limit mode and a limit cancellation mode, the limit mode for suspending formation of the set of sheets after the number of sets of sheets accumulated on the tray has reached the maximum number of sets of sheets, and the limit cancellation mode for continuing formation of the set of sheets after the number of sets of sheets accumulated on the tray has reached the maximum number of sets of sheets, wherein the control section, when the stapling operation is performed a predetermined number of times in the limit cancellation mode during one job, controls the stapler unit to temporarily move to the staple discarding position after ejection of the set of sheets and before formation of the next set of sheets, and subsequently controls the stapler unit to return to the selected stapling position.

8. The stapling device according to claim 7, further comprising a sheet feeding device that sequentially feeds sheets at shorter time intervals as the sheets become smaller in size, wherein when the stapling operation is performed in the limit cancellation mode and a sheet of a predetermined size or smaller is fed by the sheet feeding device, the control section controls the sheet feeding device to delay a timing for feeding a first sheet of the next set of sheets, during the control of the stapler unit to temporarily move to the staple discarding position and to return to the selected stapling position.

9. A stapling device comprising:

a stapler unit that travels over a path including a staple discarding position and a plurality of stapling positions, the stapler unit including:

a staple section that performs stapling operation for binding a plurality of stacked sheets with a staple to form a set of sheets, the sheets stacked as result of being sequentially fed;

a cutter section that cuts tip ends of the staple to be used for binding the sheets; and a receiving section that receives the tip ends cut by the cutter at the plurality stapling positions;

a staple recovery box disposed at the staple discarding position and recovers the tip ends received by the receiving section;

a staple discarding mechanism that automatically discards the tip ends received in the receiving section from the stapler unit into the staple recovery box; and a tray that accumulates a number of the set of sheets that are sequentially ejected every time the set of sheets is formed, the tray being configured a maximum number of sets of sheets to be carried, wherein the stapling unit forms the set of sheets in accordance with a job that directs the stapling operation to be performed at one or a plurality of stapling positions selected from the plurality of stapling positions to form one or a plurality of sets of sheets, and wherein the receiving section has a volume greater than a volume for holding all of tip ends cut from staples of a number required to obtain the maximum number of sets of sheets formed by stapling a plurality of stacked sheets with staples at a maximum selectable number of the stapling positions.

10. The stapling device according to claim 9, further comprising a control section that controls to perform the stapling operation in one of a limit mode and a limit cancellation mode, the limit mode for suspending formation of the set of sheets after the number of sets of sheets accumulated on the tray has reached the maximum number of sets of sheets, and the limit cancellation mode for continuing formation of the set of sheets after the number of sets of sheets accumulated on the tray has reached the maximum number of sets of sheets, wherein the control section, when the stapling operation is performed a predetermined number of times in the limit cancellation mode during one job, controls the stapler unit to temporarily move to the staple discarding position after ejection of the set of sheets and before formation of the next set of sheets, and subsequently controls the stapler unit to return to the selected stapling position.

11. The stapling device according to claim 10, further comprising a sheet feeding device that sequentially feeds sheets at shorter time intervals as the sheets become smaller in size, wherein when the stapling operation is performed in the limit cancellation mode and a sheet of a predetermined size or smaller is fed by the sheet feeding device, the control section controls the sheet feeding device to delay a timing for feeding a first sheet of the next set of sheets, during the control of the stapler unit to temporarily move to the staple discarding position and to return to the selected stapling position.

* * * * *